US011168386B2

(12) United States Patent
Lee et al.

(10) Patent No.: US 11,168,386 B2
(45) Date of Patent: Nov. 9, 2021

(54) HIGH-ENTROPY ALLOY FOR ULTRA-LOW TEMPERATURE

(71) Applicants: POSTECH ACADEMY-INDUSTRY FOUNDATION, Pohang-si (KR); The Industry & Academic Cooperation in Chungnam National University, Daejeon (KR)

(72) Inventors: Byeong-joo Lee, Pohang-si (KR); Sung-hak Lee, Pohang-si (KR); Hyoung-seop Kim, Pohang-si (KR); Young-sang Na, Changwon-si (KR); Sun-ig Hong, Daejeon (KR); Won-mi Choi, Pohang-si (KR); Chang-woo Jeon, Suwon-si (KR); Seung-mun Jung, Yangsan-si (KR)

(73) Assignees: POSTECH ACADEMY-INDUSTRY FOUNDATION, Pohang-si (KR); THE INDUSTRY & ACADEMIC COOPERATION IN CHUNGNAM NATIONAL UNIVERSITY, Daejeon (KR)

( * ) Notice: Subject to any disclaimer, the term of this patent is extended or adjusted under 35 U.S.C. 154(b) by 81 days.

(21) Appl. No.: 16/084,581

(22) PCT Filed: Mar. 21, 2017

(86) PCT No.: PCT/KR2017/002988
§ 371 (c)(1),
(2) Date: Sep. 13, 2018

(87) PCT Pub. No.: WO2017/164601
PCT Pub. Date: Sep. 28, 2017

(65) Prior Publication Data

US 2019/0071755 A1 Mar. 7, 2019

(30) Foreign Application Priority Data

Mar. 21, 2016 (KR) ..... 10-2016-0033418
Mar. 15, 2017 (KR) ..... 10-2017-0032629

(51) Int. Cl.

| | |
|---|---|
| ***C22C 30/00*** | (2006.01) |
| ***C22C 38/46*** | (2006.01) |
| ***C22C 38/52*** | (2006.01) |
| ***C22C 38/58*** | (2006.01) |
| ***C22C 19/05*** | (2006.01) |
| *C22C 1/02* | (2006.01) |

(52) U.S. Cl.
CPC ..... *C22C 30/00* (2013.01); *C22C 19/05* (2013.01); *C22C 19/058* (2013.01); *C22C 38/46* (2013.01); *C22C 38/52* (2013.01); *C22C 38/58* (2013.01); *C22C 1/023* (2013.01)

(58) Field of Classification Search
CPC ..... C22C 30/00; C22C 19/05; C22C 19/058; C22C 38/46; C22C 38/52; C22C 38/58; C22C 1/023
See application file for complete search history.

(56) References Cited

U.S. PATENT DOCUMENTS

| | | | | |
|---|---|---|---|---|
| 2008/0031769 | A1* | 2/2008 | Yeh | C22C 1/03 420/580 |
| 2016/0025386 | A1 | 1/2016 | Barabash et al. | |
| 2017/0209954 | A1* | 7/2017 | Kato | C22C 30/00 |
| 2017/0233855 | A1* | 8/2017 | Park | C22C 38/06 420/44 |

FOREIGN PATENT DOCUMENTS

| | | | |
|---|---|---|---|
| JP | 2002-173732 | 6/2002 | |
| JP | 2016-023352 | 2/2016 | |
| KR | 10-2009-0030198 | 3/2009 | |
| KR | 10-2016-0014130 | 2/2016 | |
| WO | WO-2016013498 A1 * | 1/2016 | B33Y 70/00 |

OTHER PUBLICATIONS

Stepanov; N.D., et al. "Effect of V content on microstructure and mechanical properties of the CoCrFeMnNiVx high entropy alloys," Jan. 8, 2015, Journal of Alloys and Compounds vol. 628, p. 170-185 (Year: 2015).*

M. V. Karpets et al. "Effect of Nickel on the Structure and Phase Composition of the VCrMnFeCoNix High Entropy Alloy" Journal of Superhard Materials, vol. 37, No. 3, pp. 182-188 (Year: 2015).*

* cited by examiner

*Primary Examiner* — Anthony J Zimmer
*Assistant Examiner* — Dean Mazzola
(74) *Attorney, Agent, or Firm* — Lex IP Meister, PLLC

(57) ABSTRACT

The present invention relates to a high-entropy alloy especially having excellent low-temperature tensile strength and elongation by means of having configured, through thermodynamic calculations, an alloy composition region having an FCC single-phase microstructure at 700° C. or higher, and enabling the FCC single-phase microstructure at room temperature and at an ultra-low temperature. The high-entropy alloy, according to the present invention, comprises: Co: 3-12 at %; Cr: 3-18 at %; Fe: 3-50 at %; Mn: 3-20 at %; Ni: 17-45 at %; V: 3-12 at %; and unavoidable impurities, wherein the ratio of the V content to the Ni content (V/Ni) is 0.5 or less, and the sum of the V content and the Co content is 22 at % or less.

9 Claims, 34 Drawing Sheets

【FIG.1】
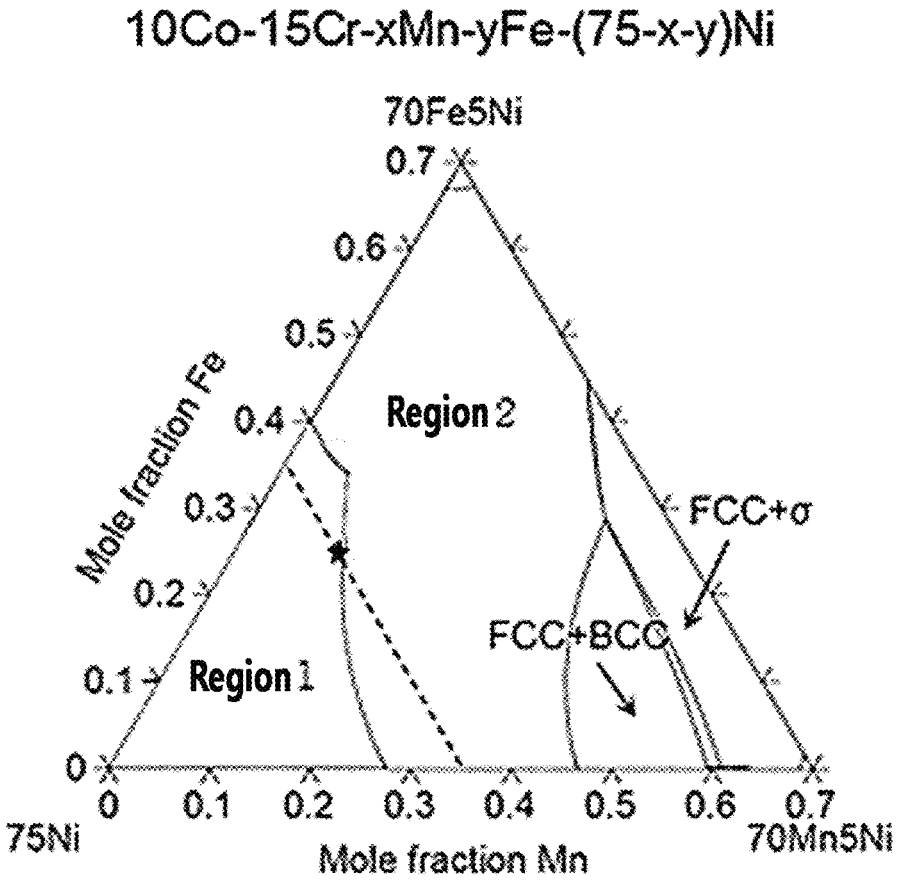

[FIG.2]
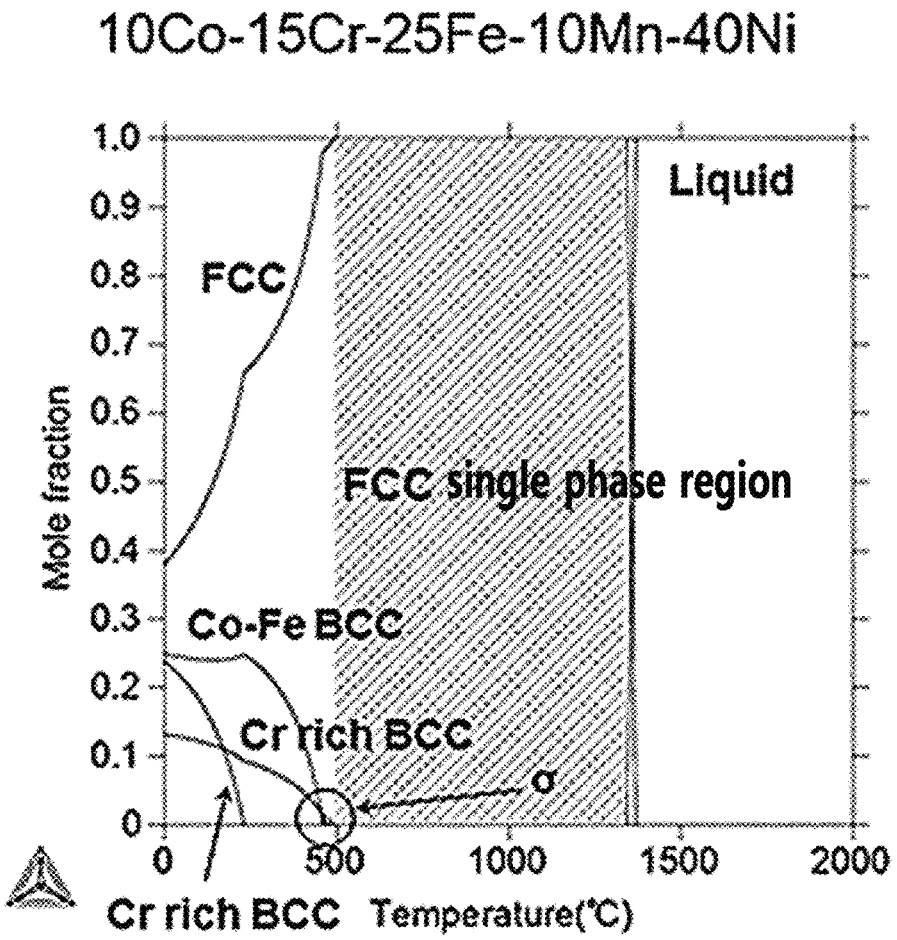

[FIG.3]
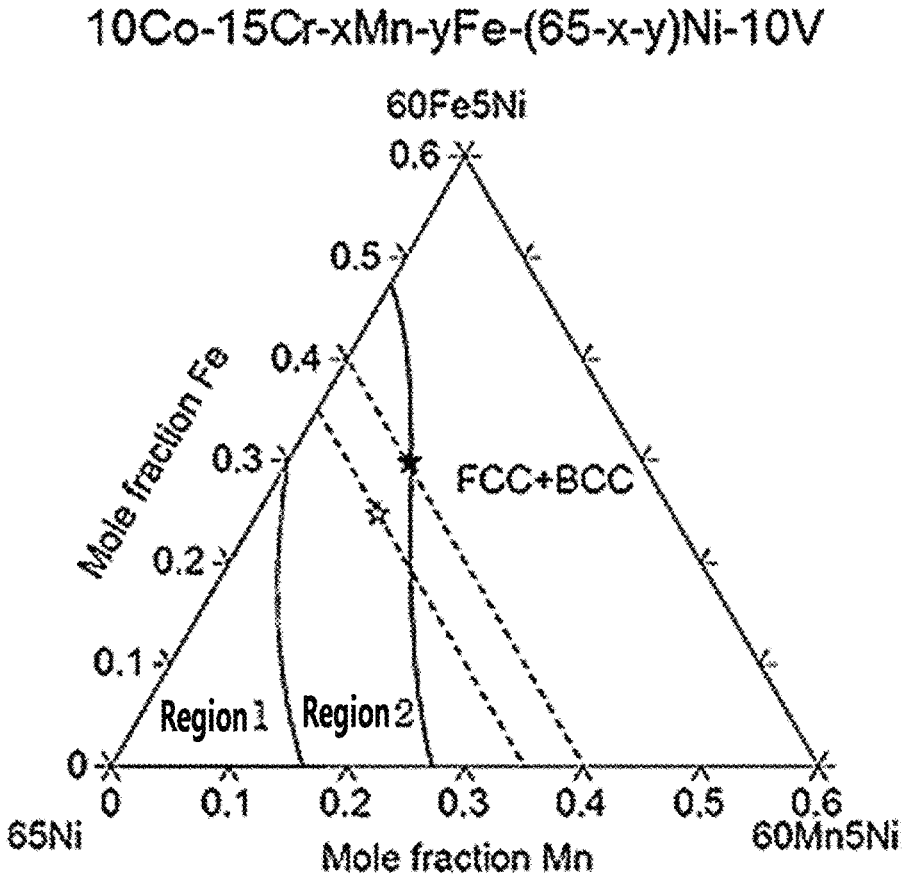

[FIG.4]
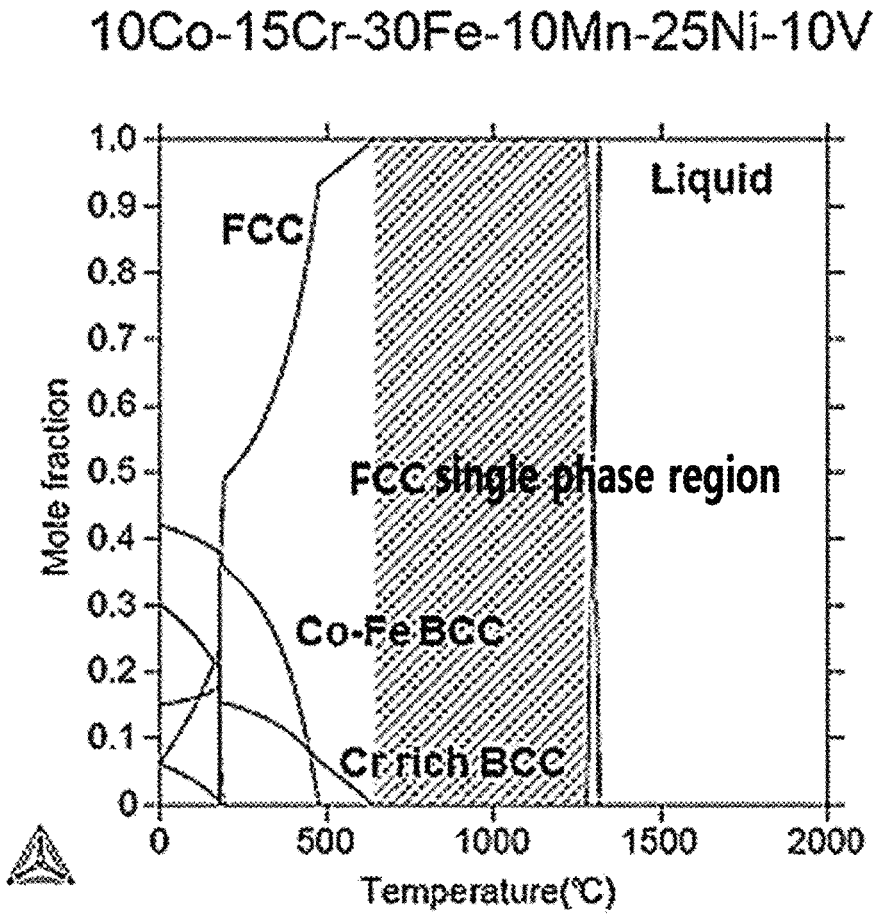

[FIG.5]
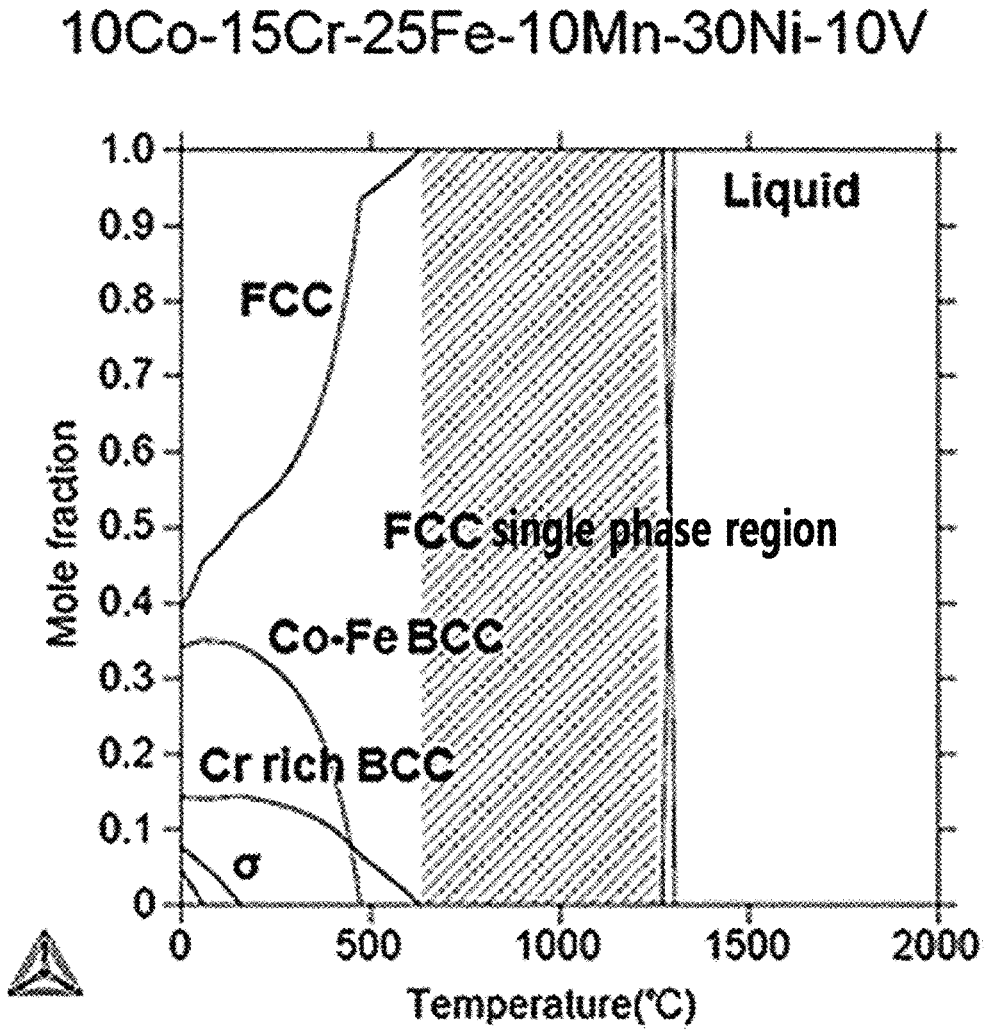

[FIG.6]
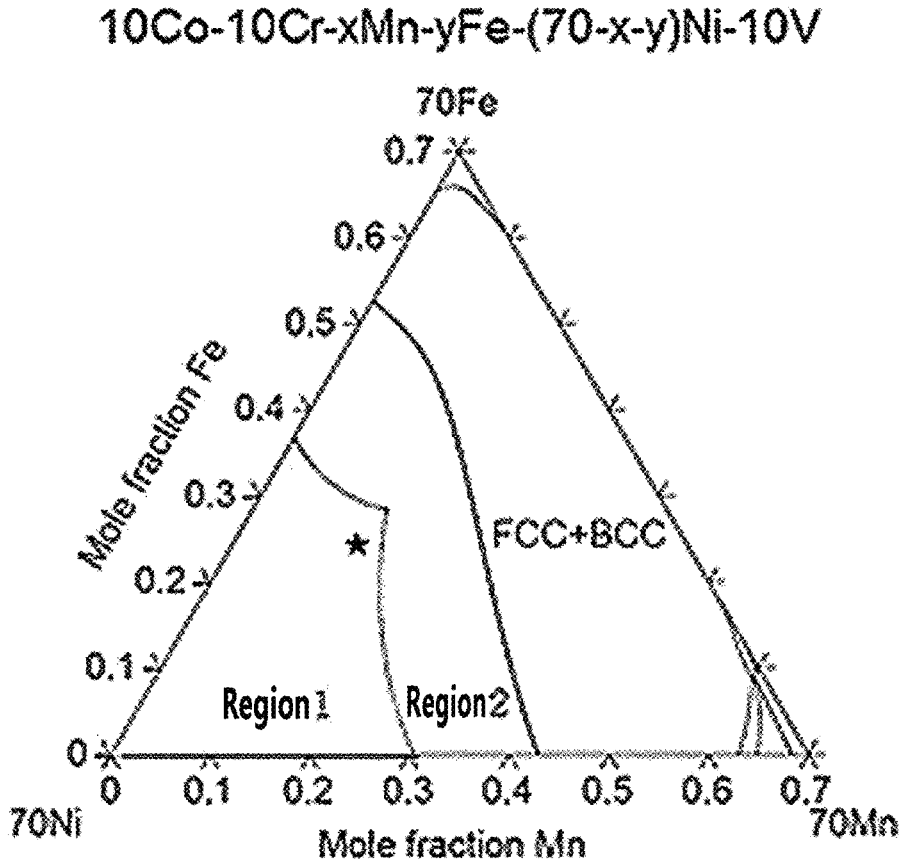

[FIG.7]
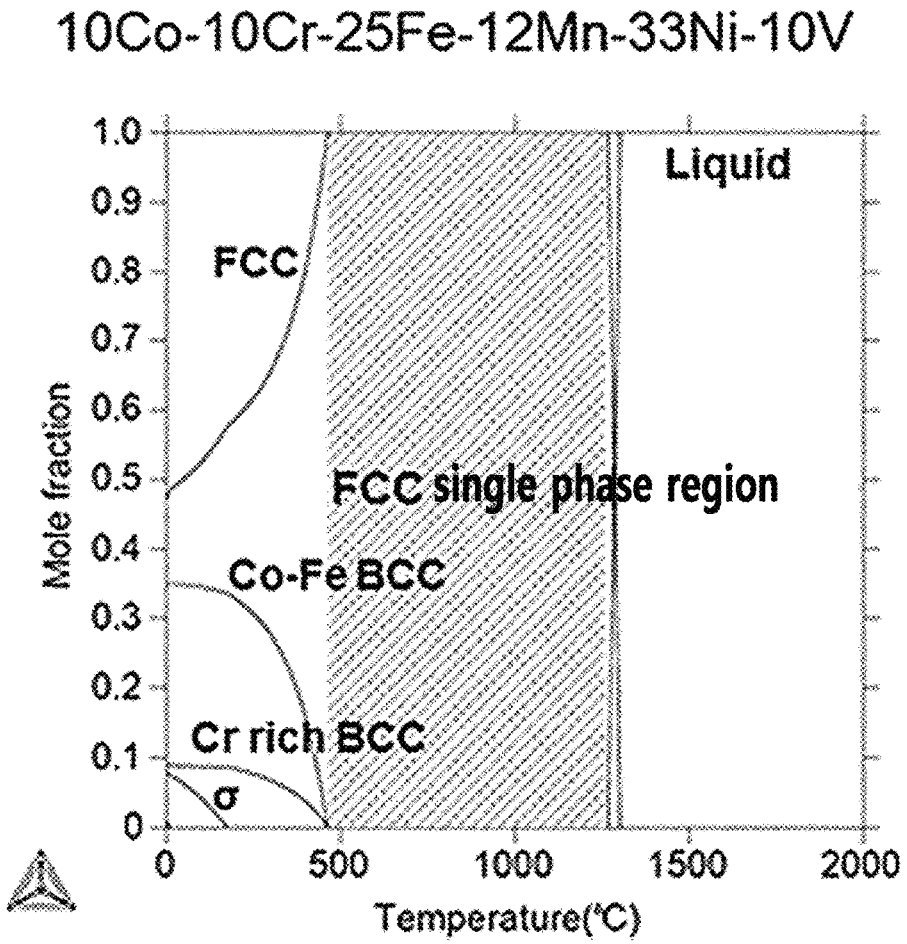

[FIG.8]
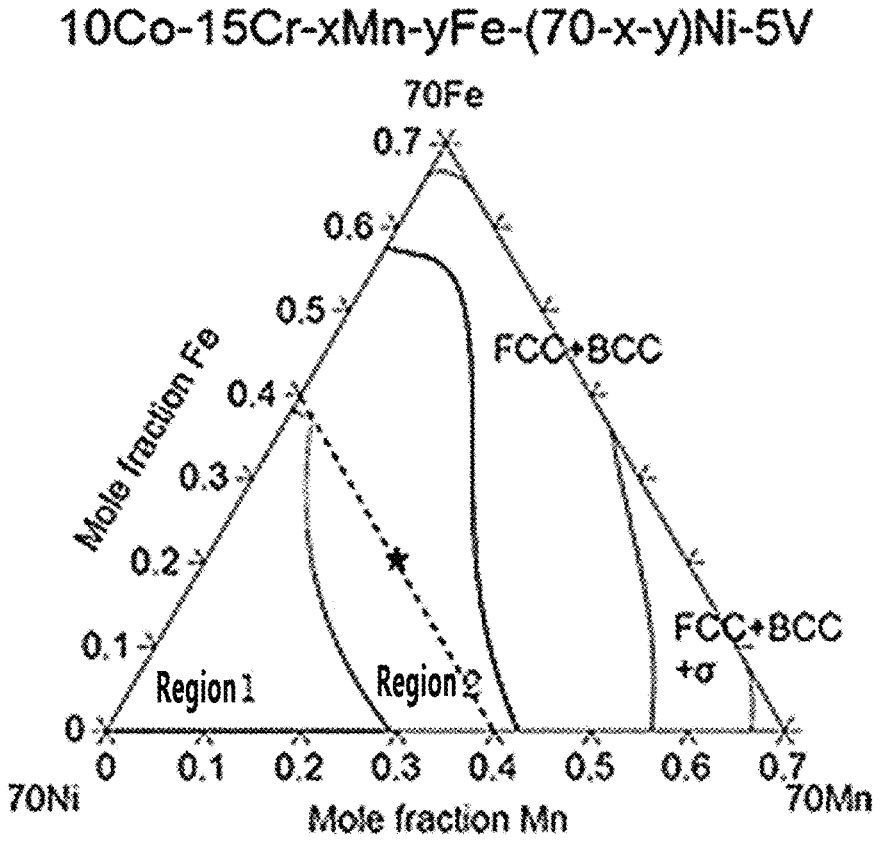

[FIG.9]
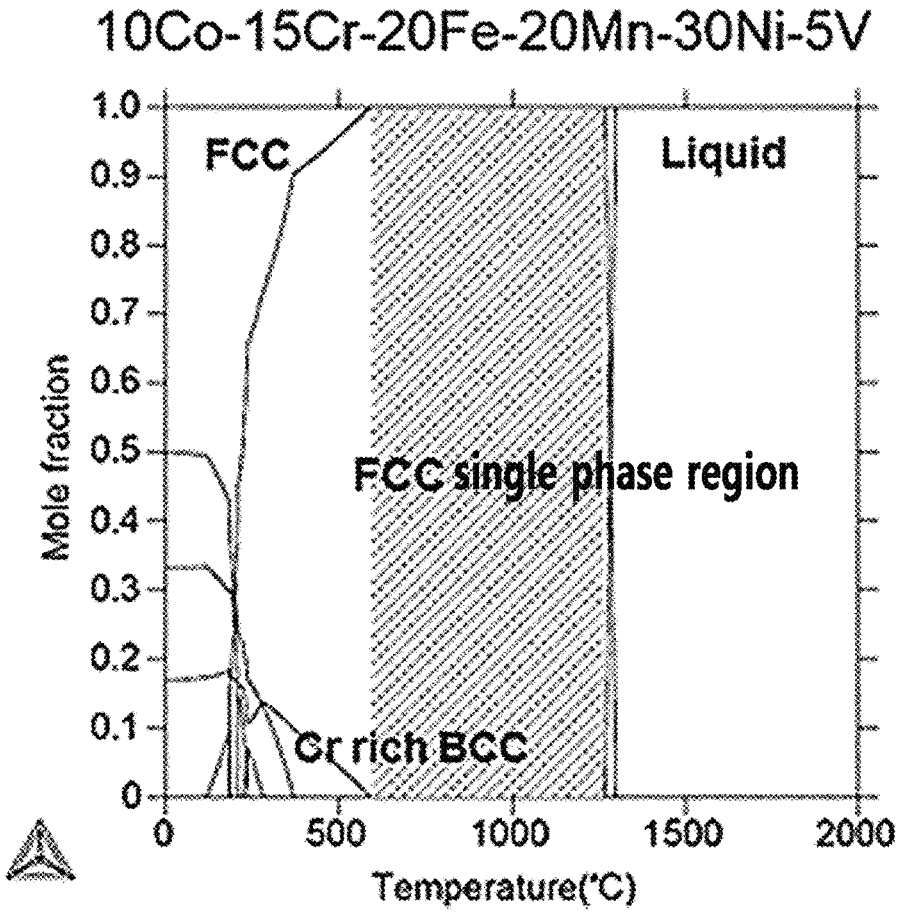

【FIG.10】
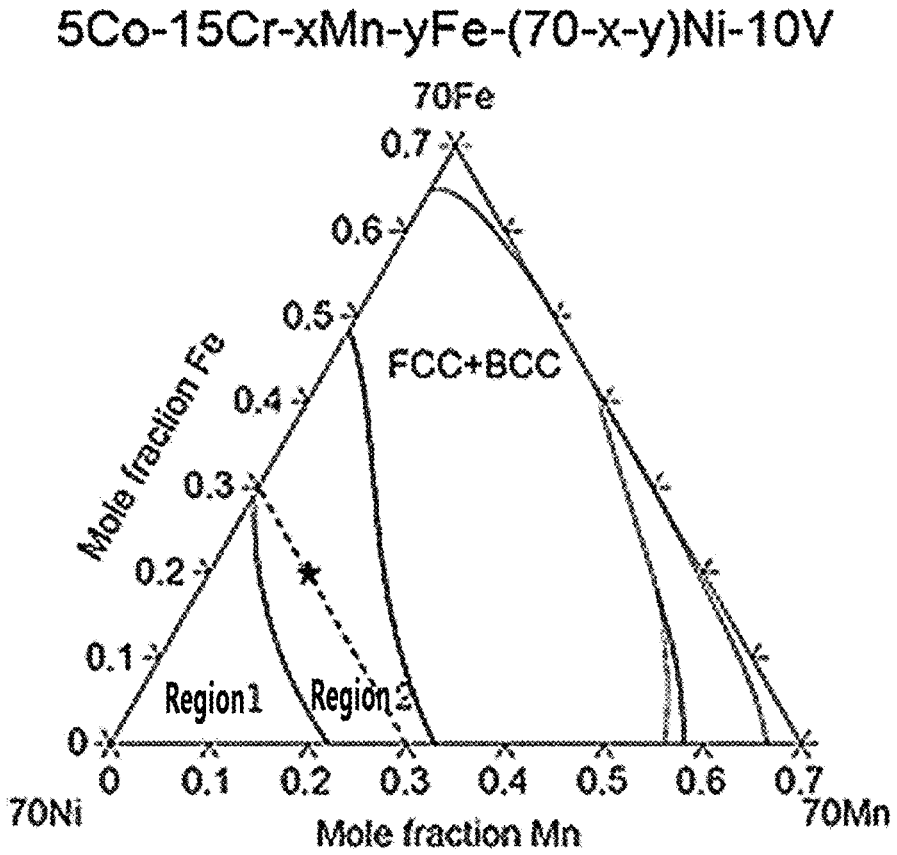

【FIG.11】
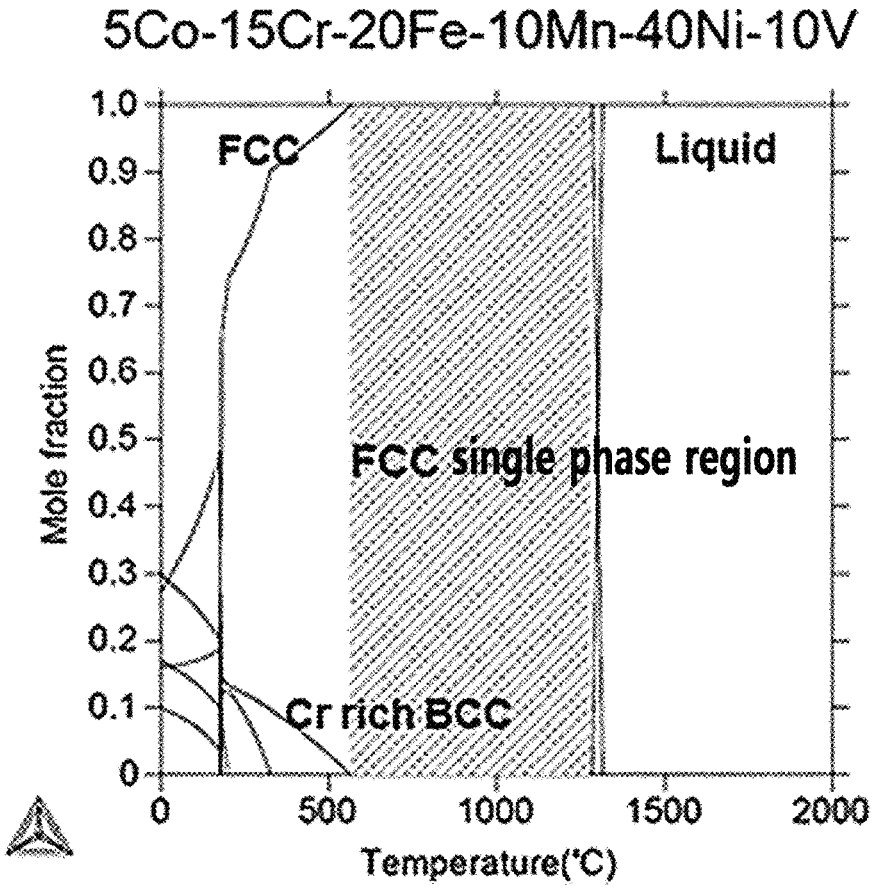

[FIG.12a]
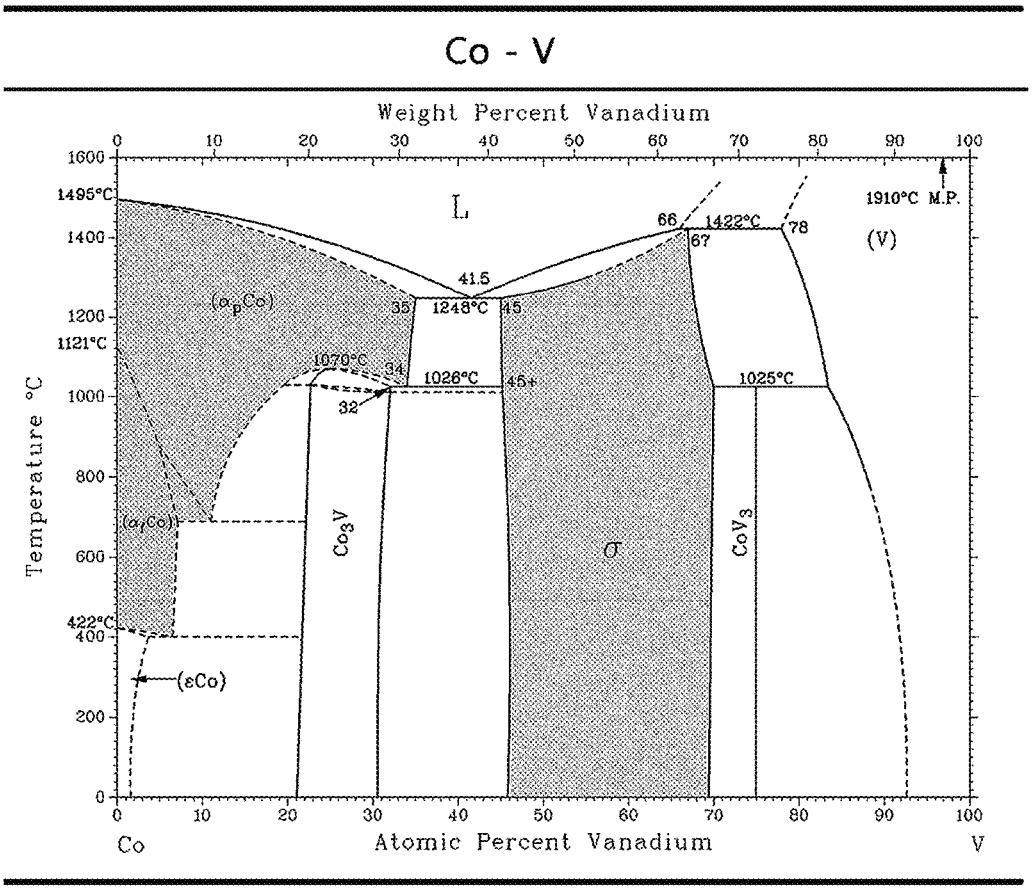

[FIG.12b]
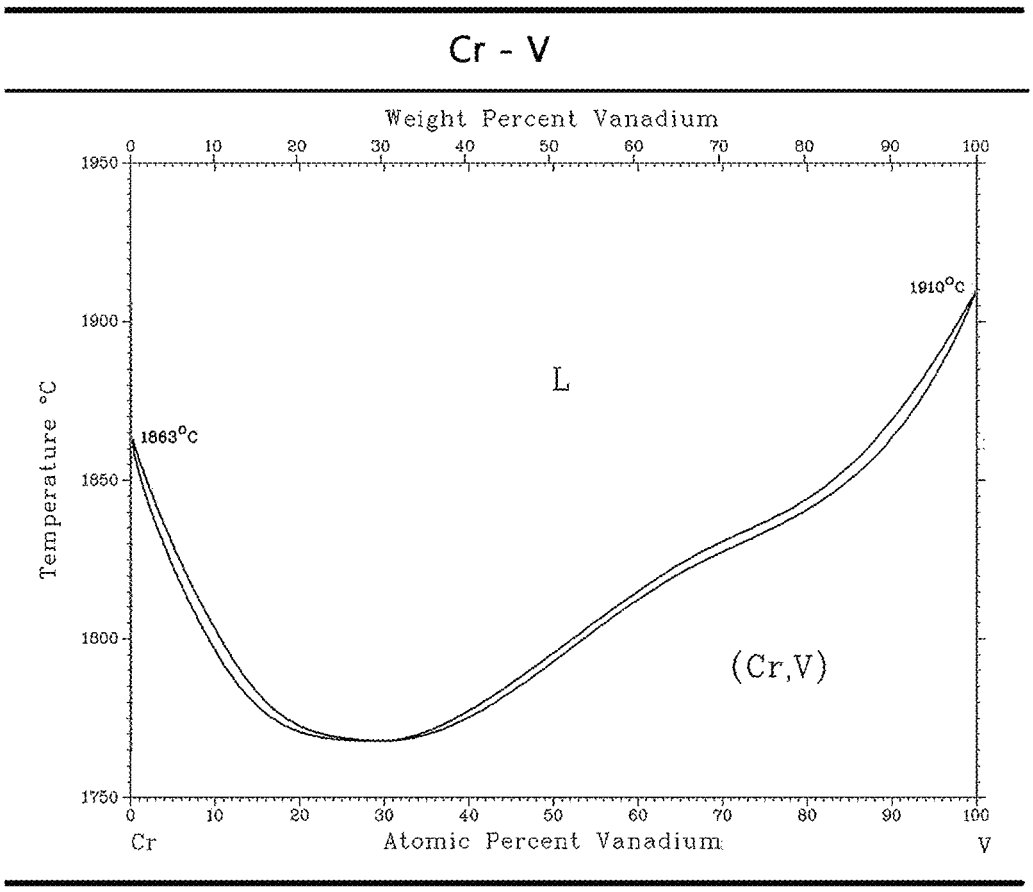

[FIG.12c]
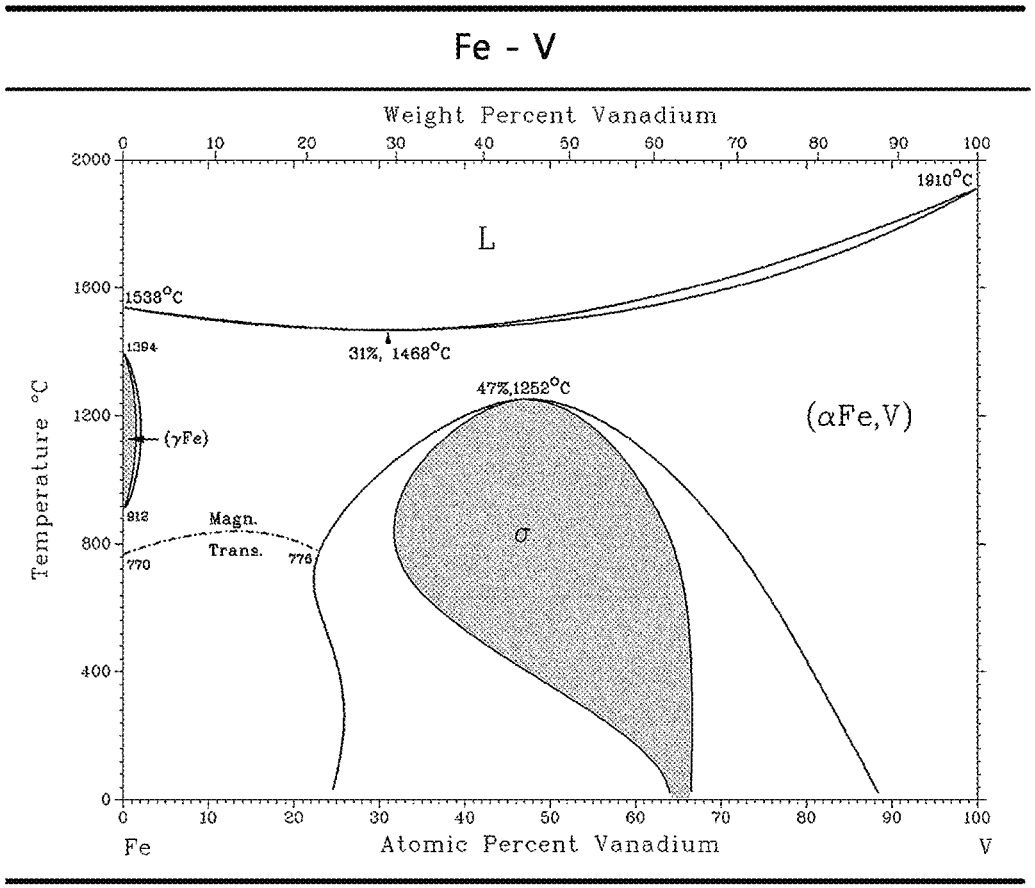

[FIG.12d]
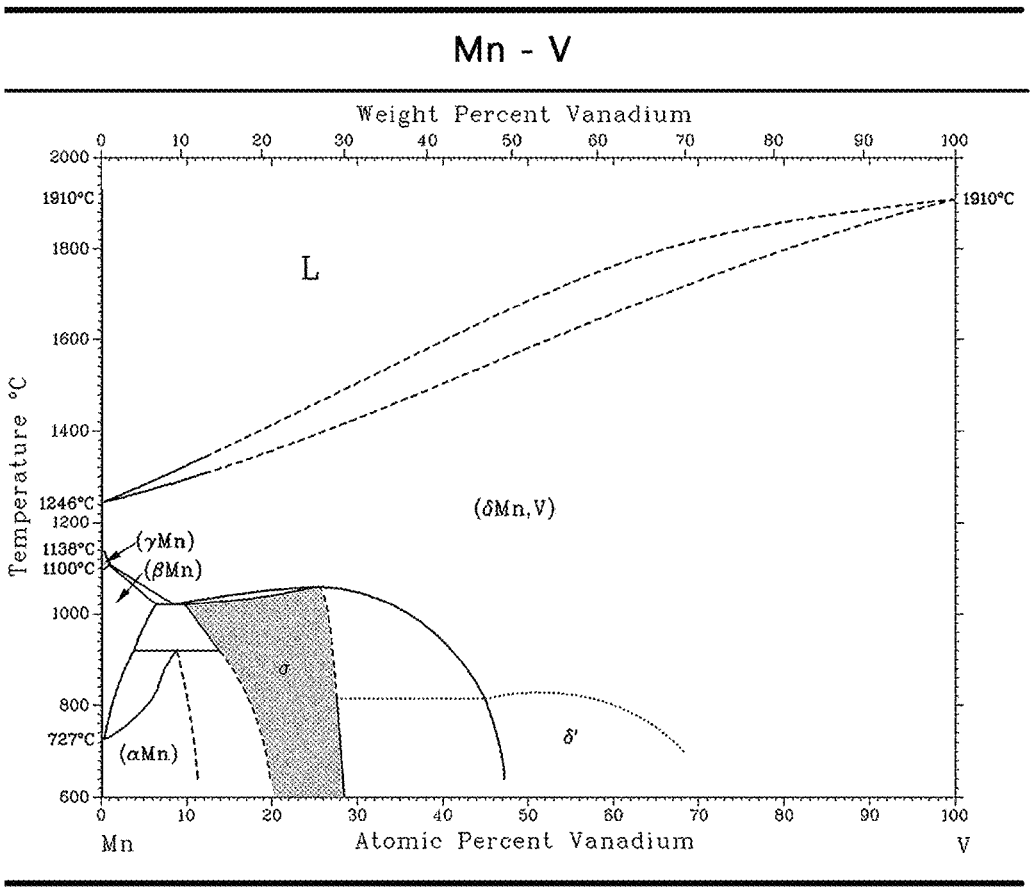

[FIG.12e]
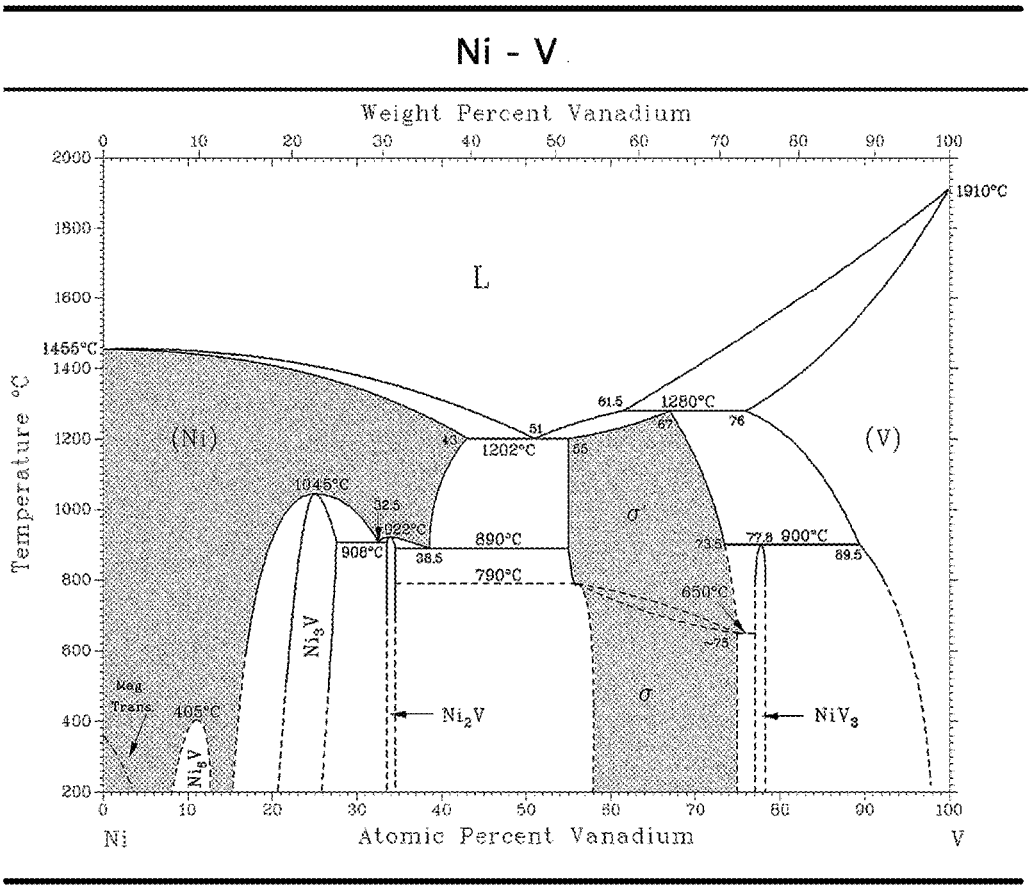

[FIG.12f]
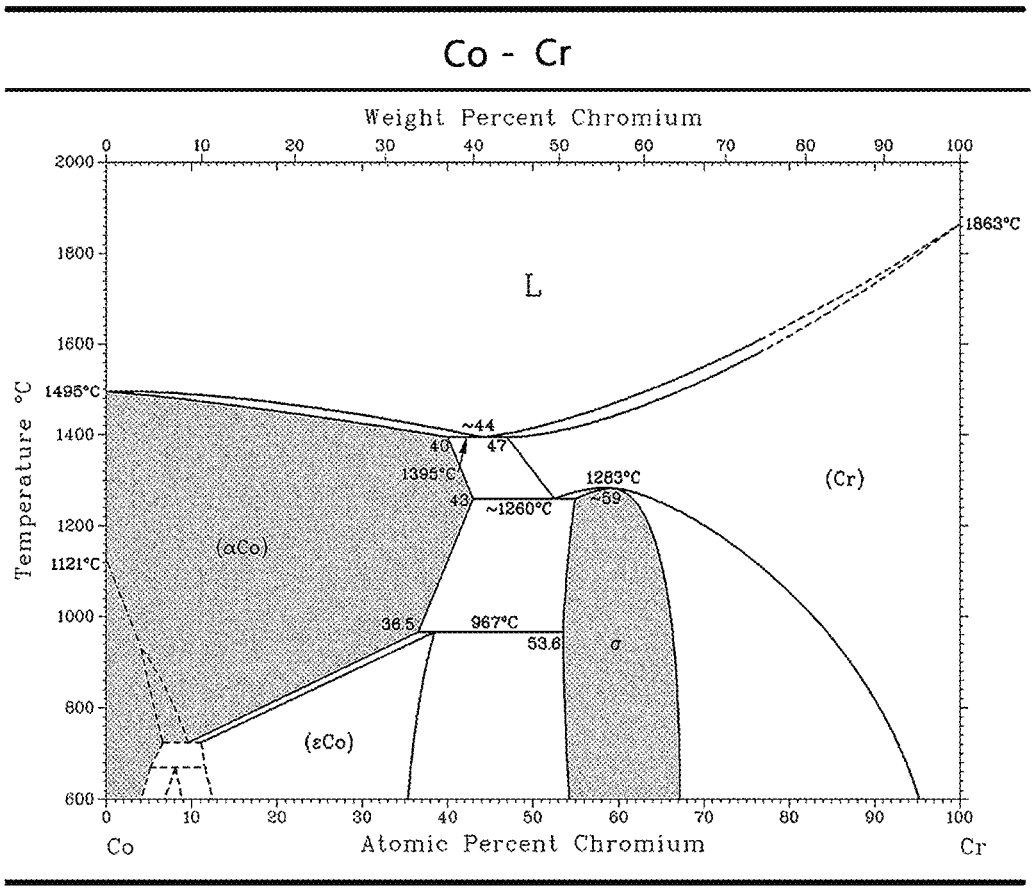

[FIG.12g]
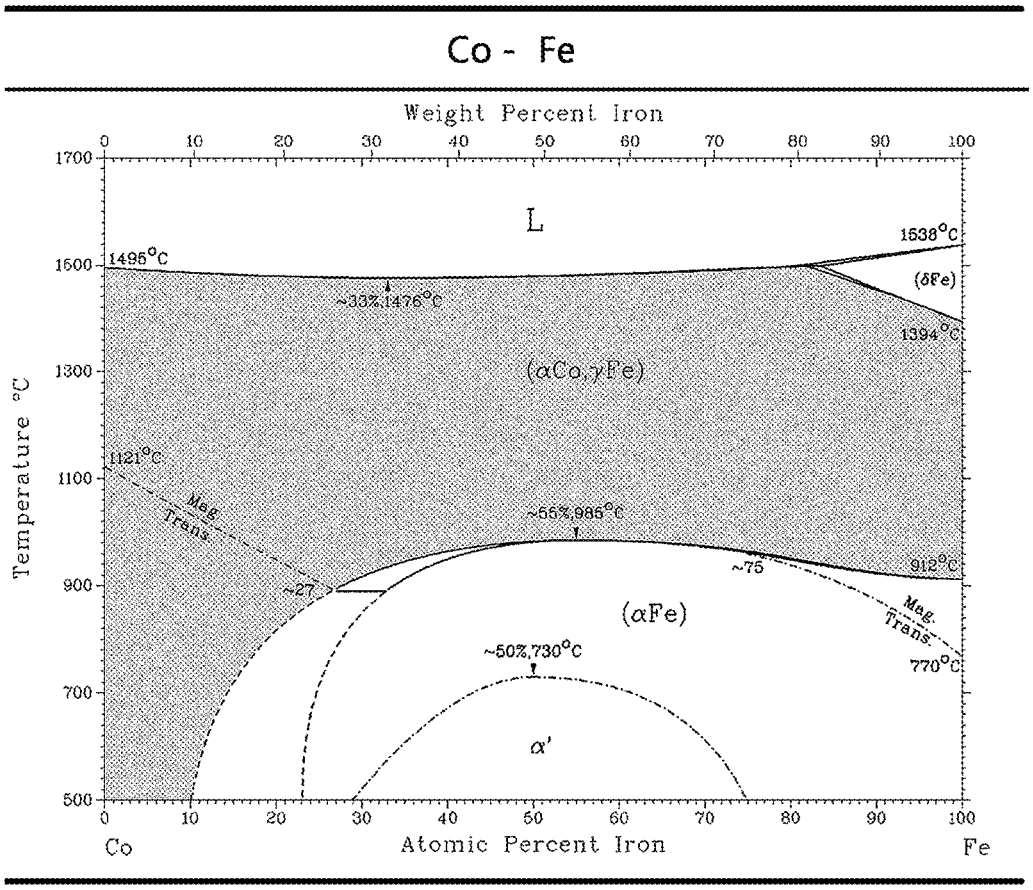

[FIG.12h]
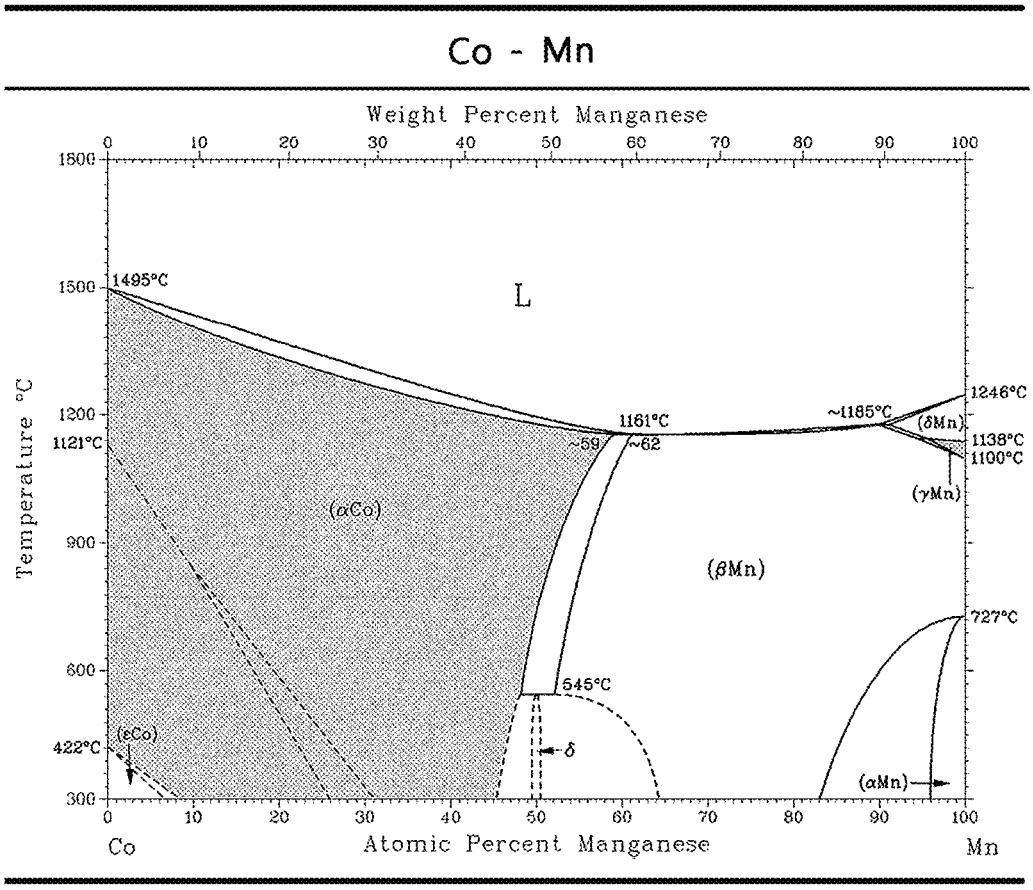

[FIG.12i]
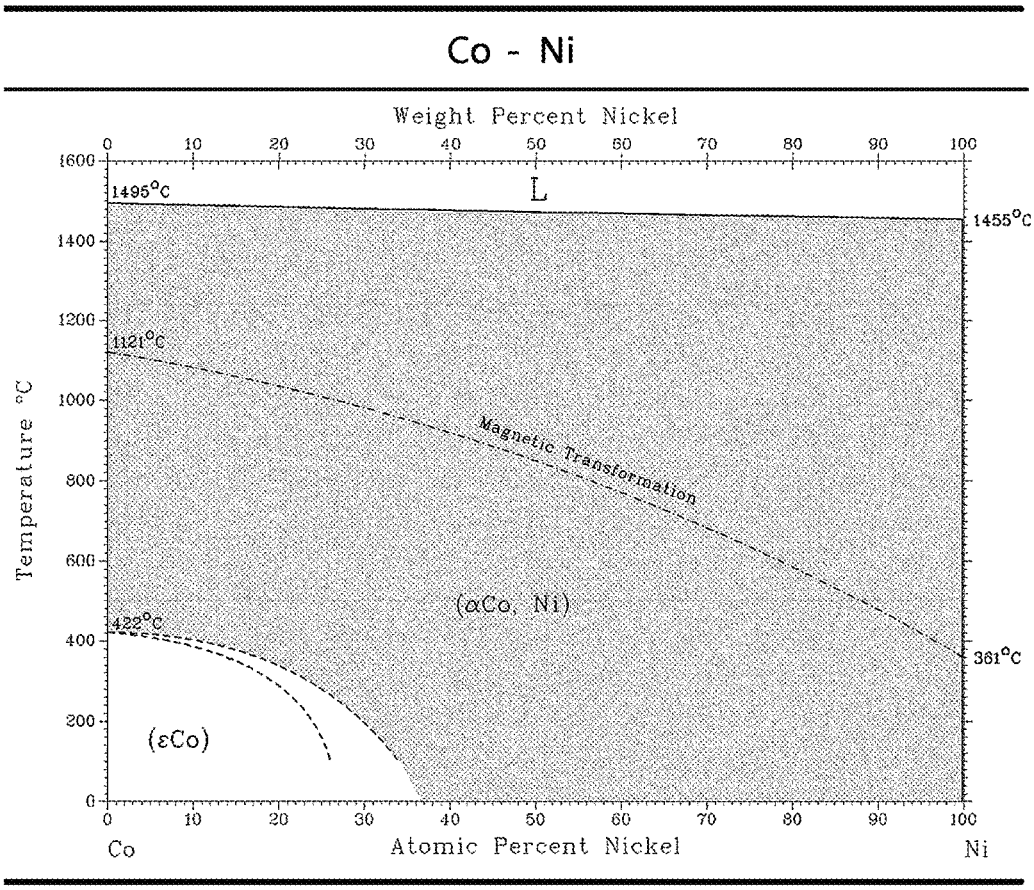

[FIG.12j]
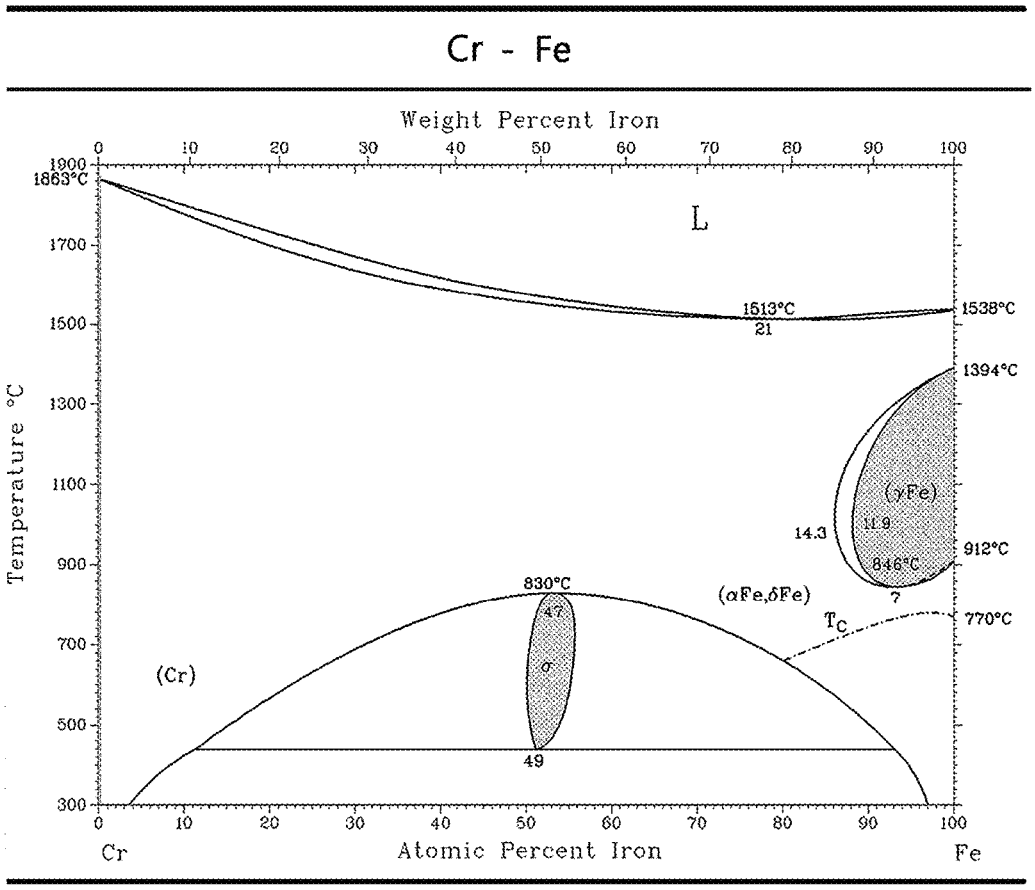

[FIG.12k]
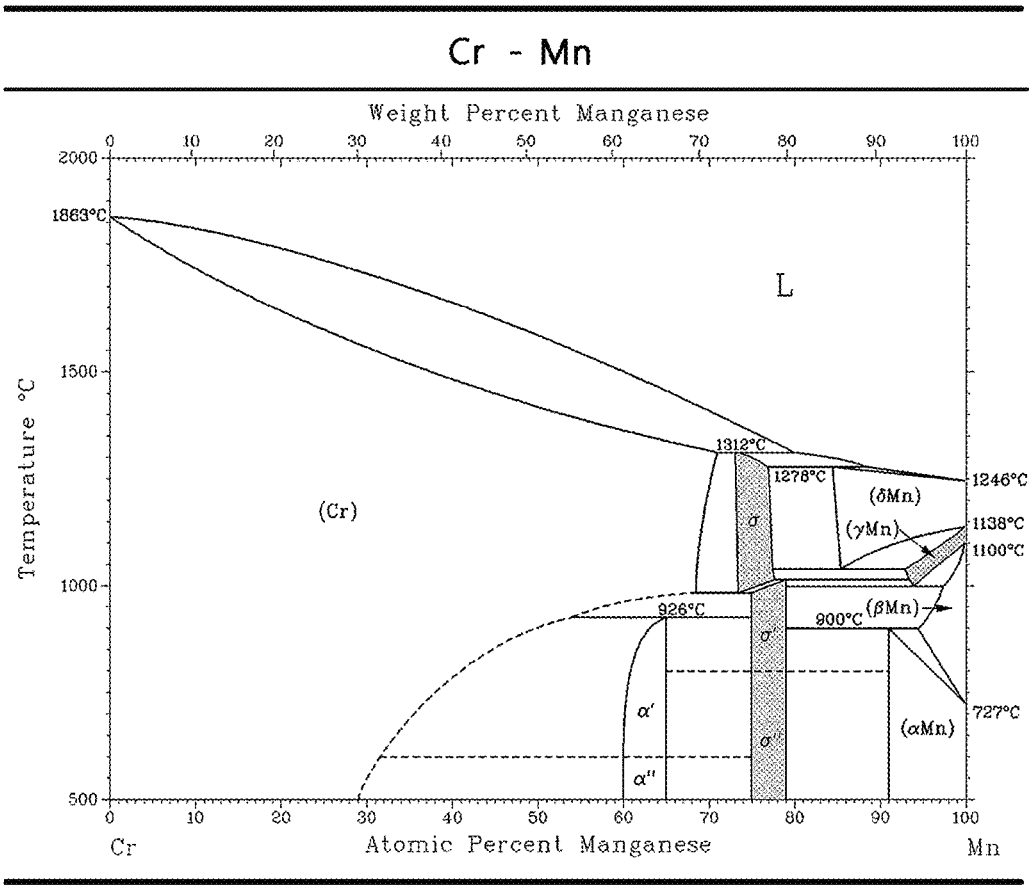

[FIG.12I]
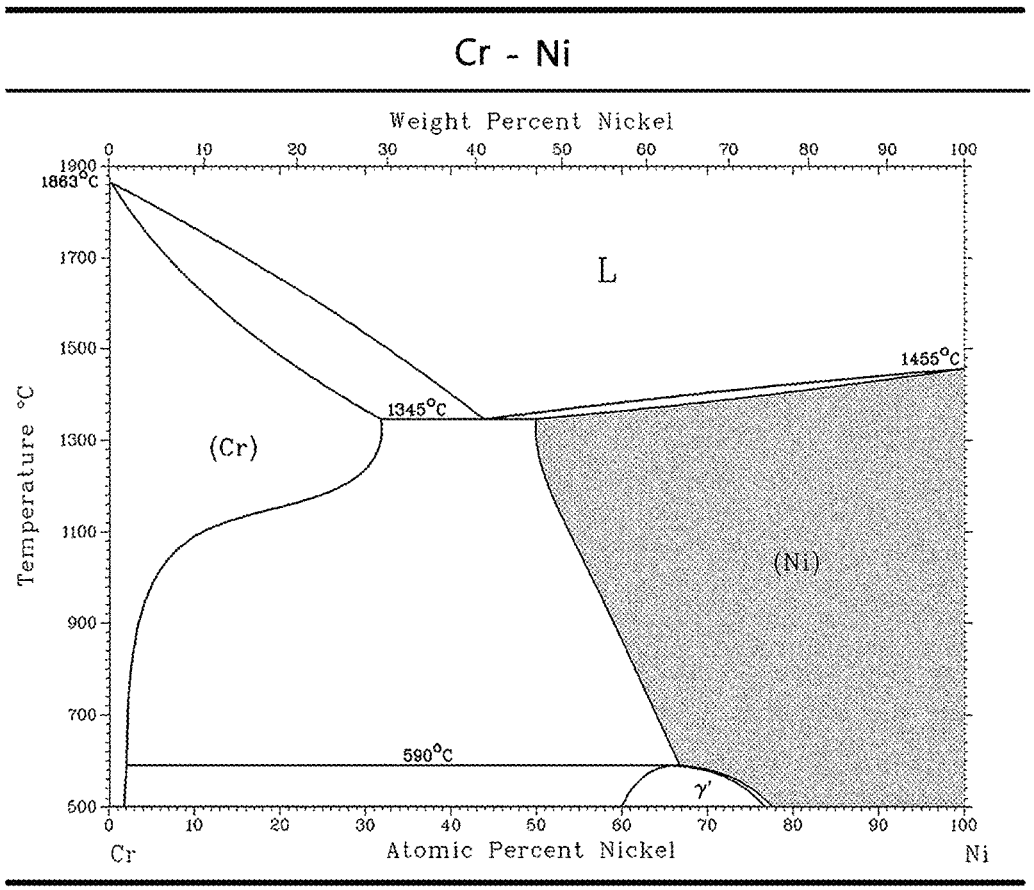

[FIG.12m]
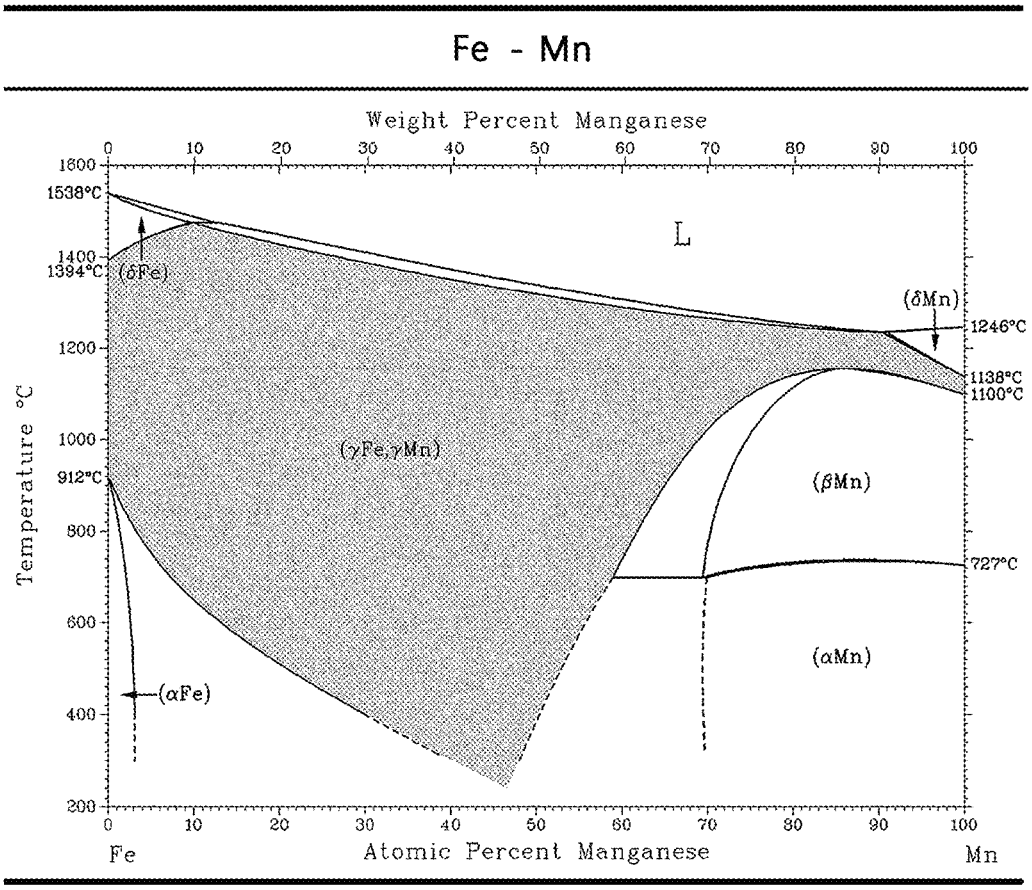

[FIG.12n]
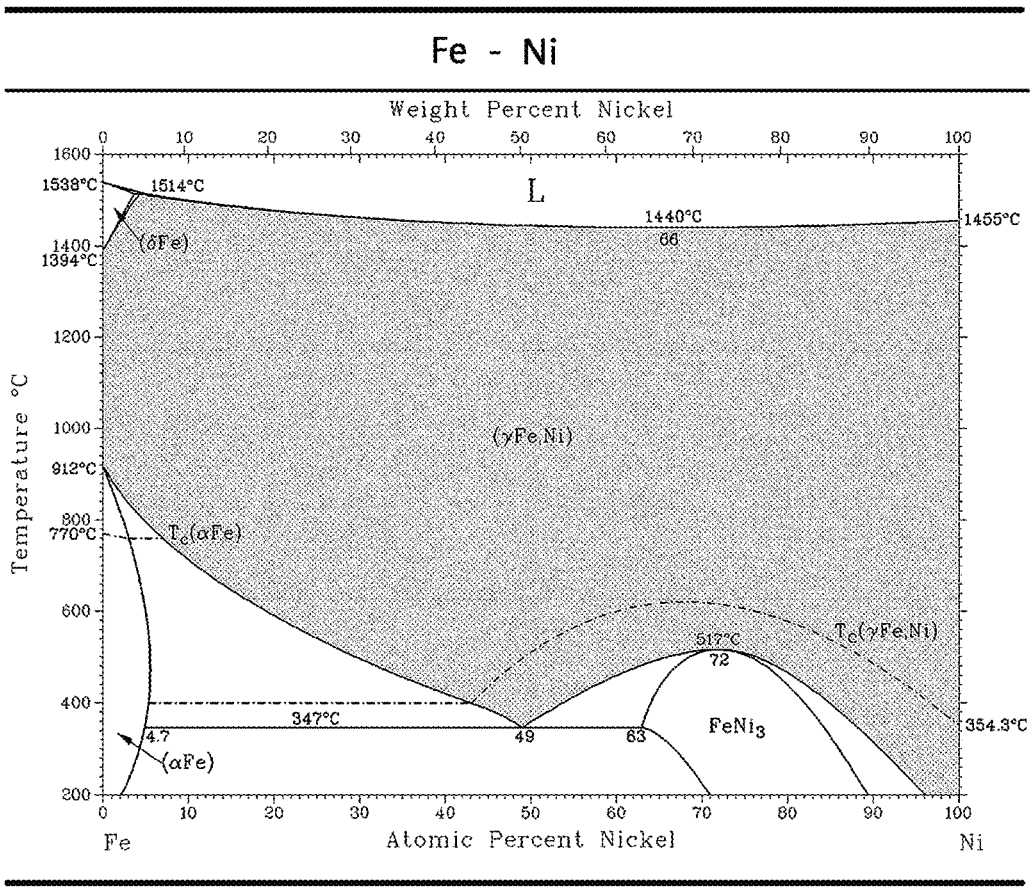

[FIG.12o]
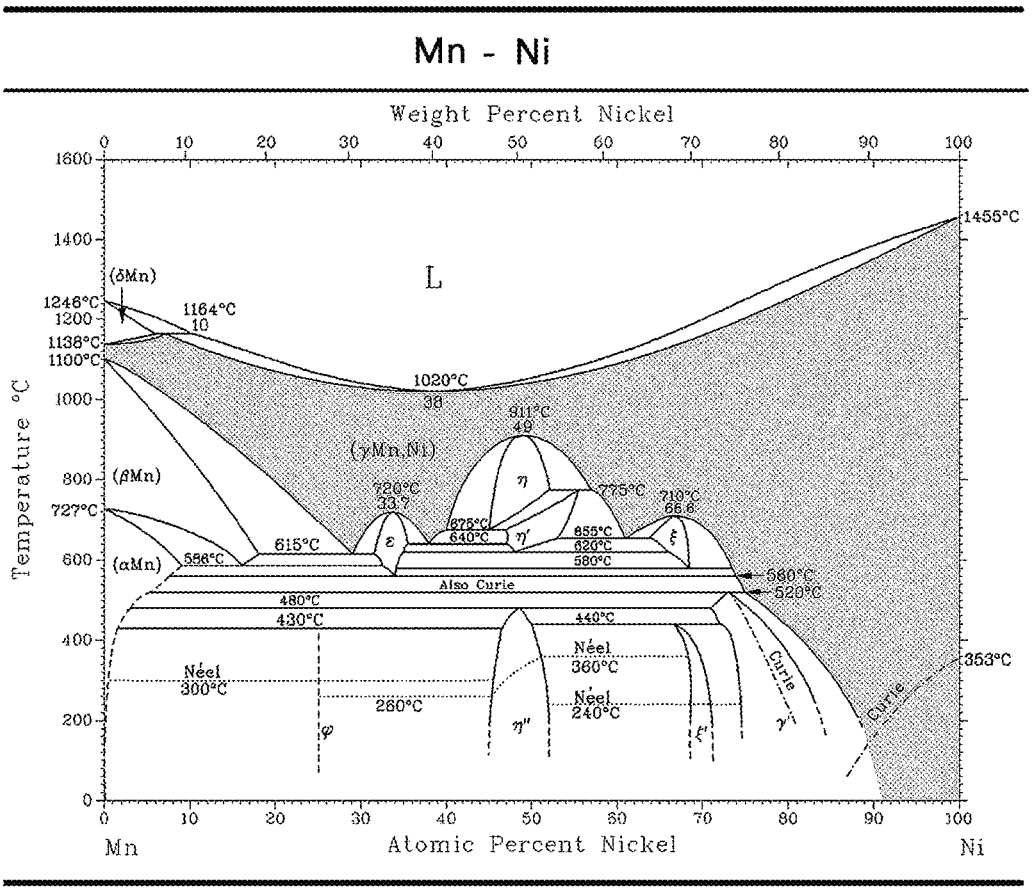

[FIG.13]
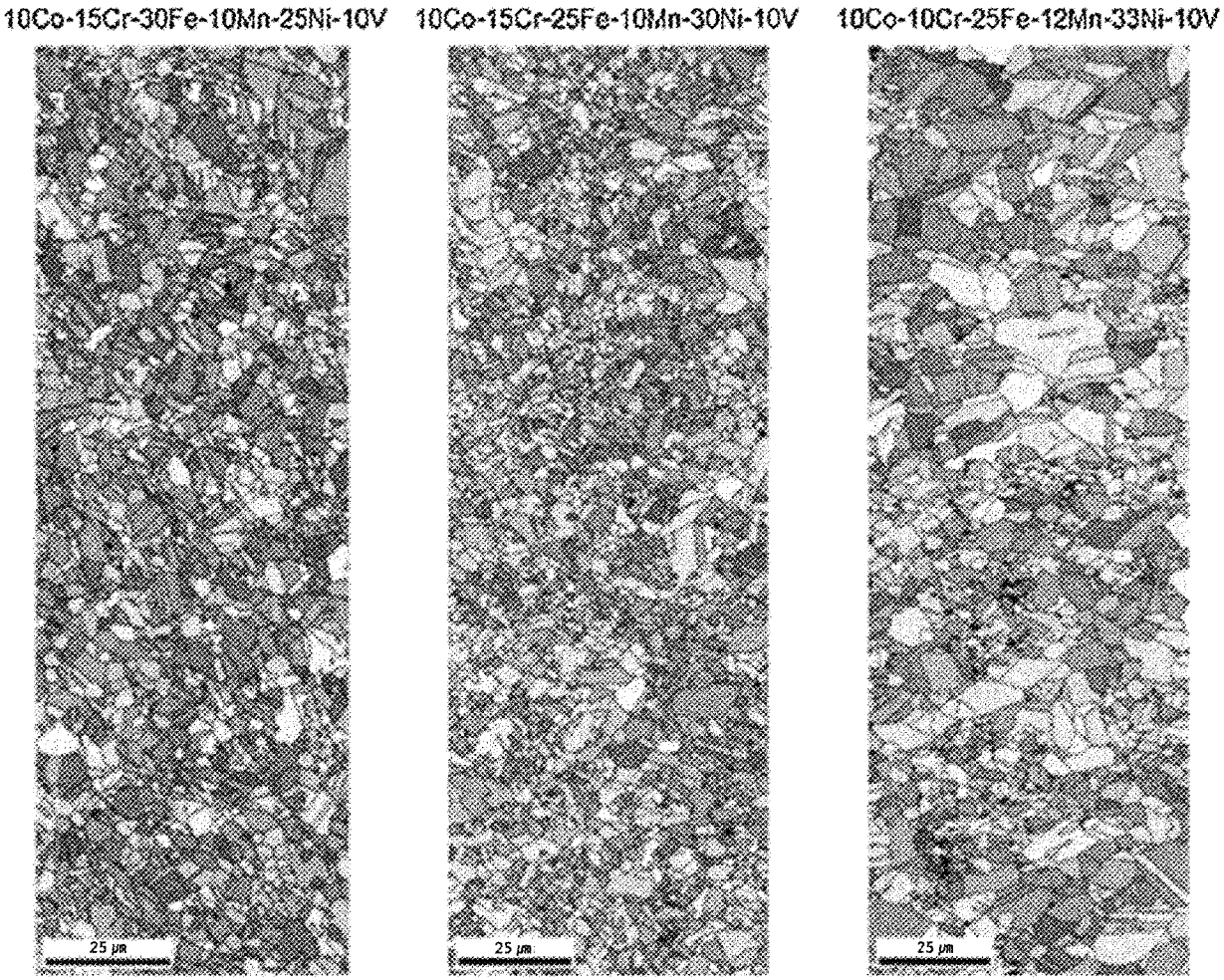

[FIG.14]
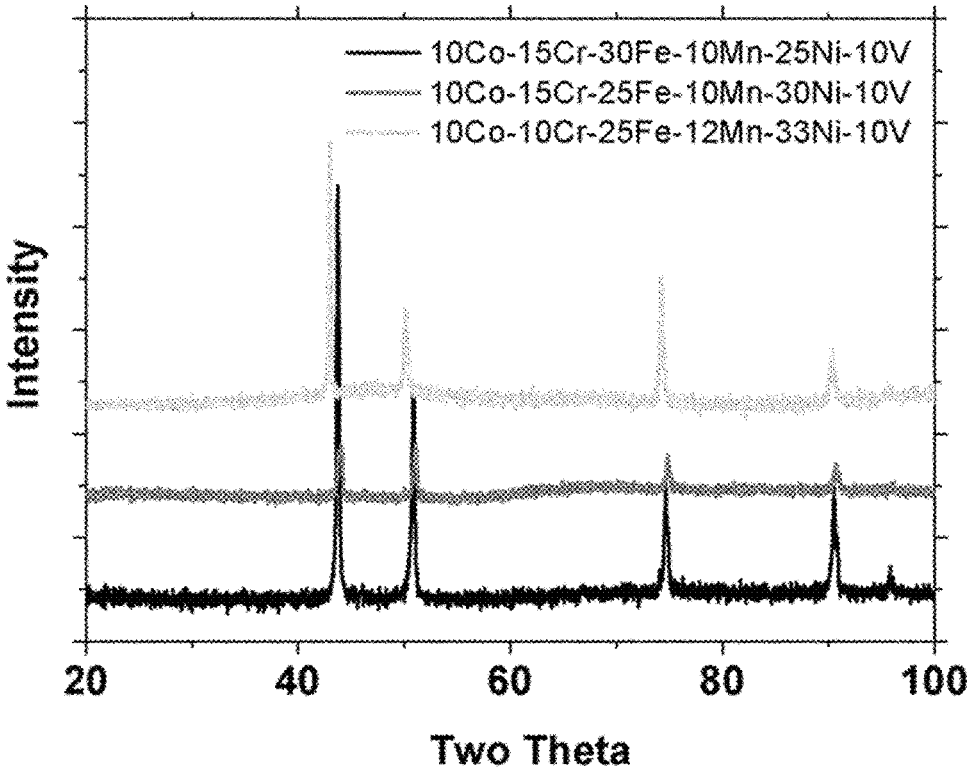

[FIG.15]
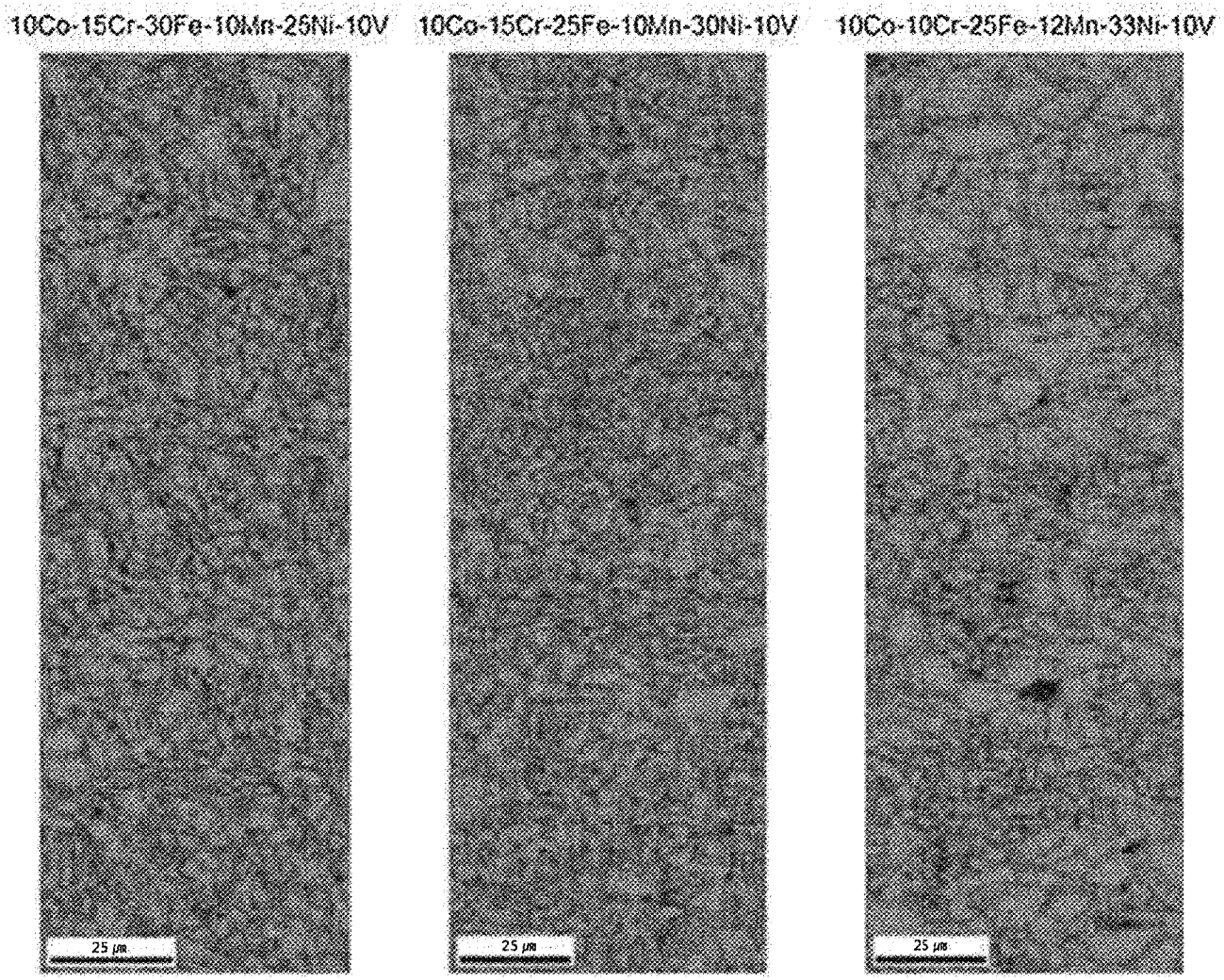

[FIG.16]
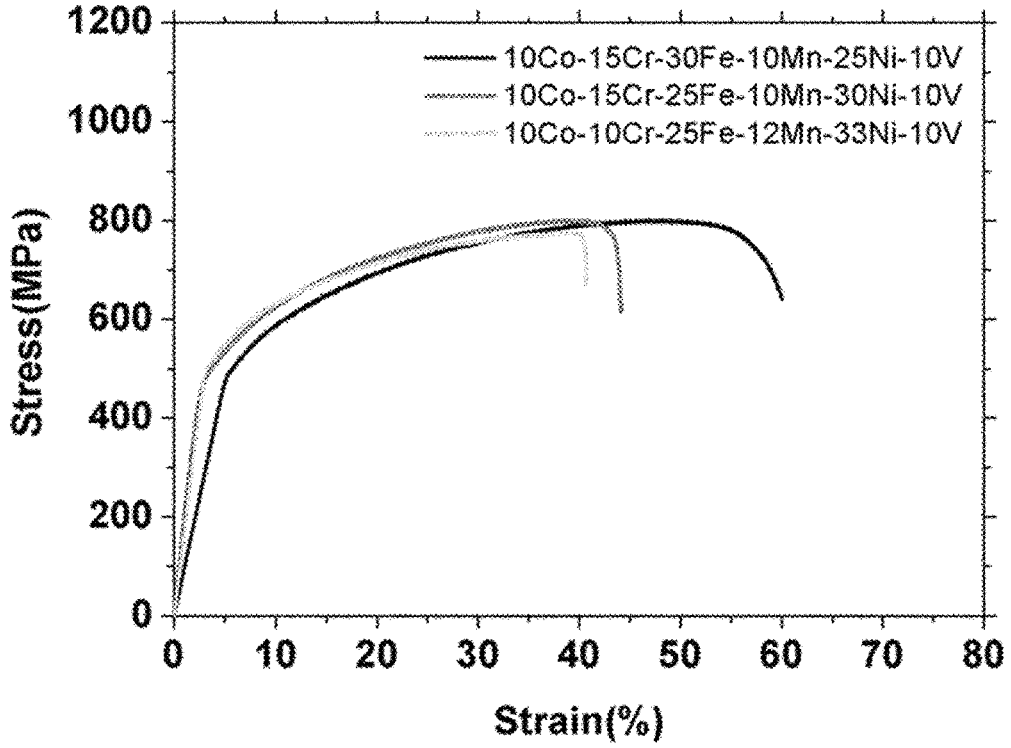

[FIG.17]
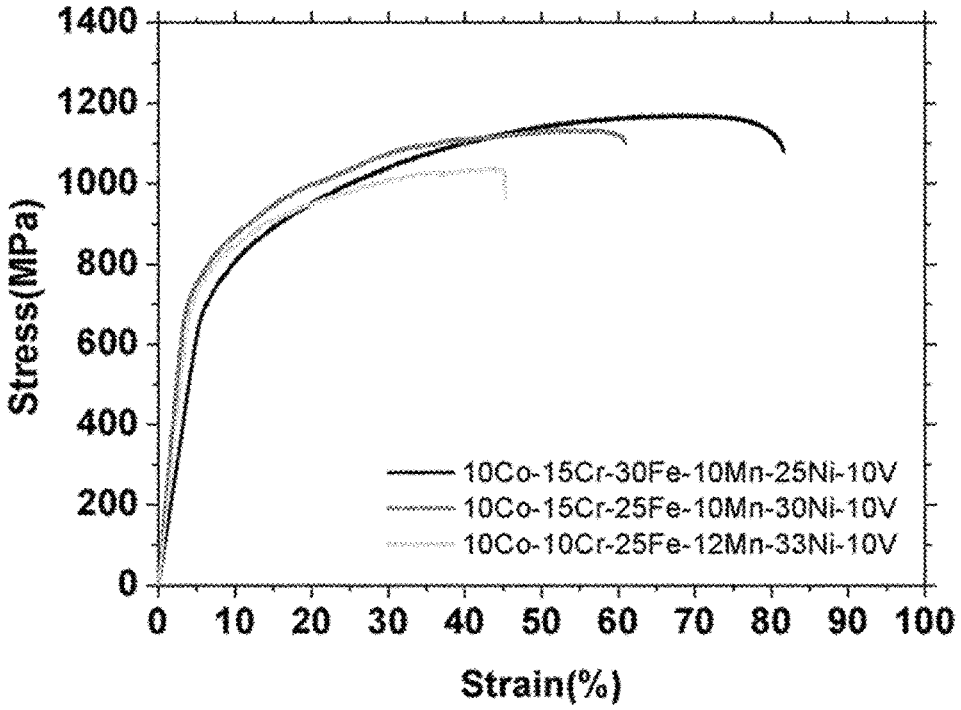

[FIG.18]
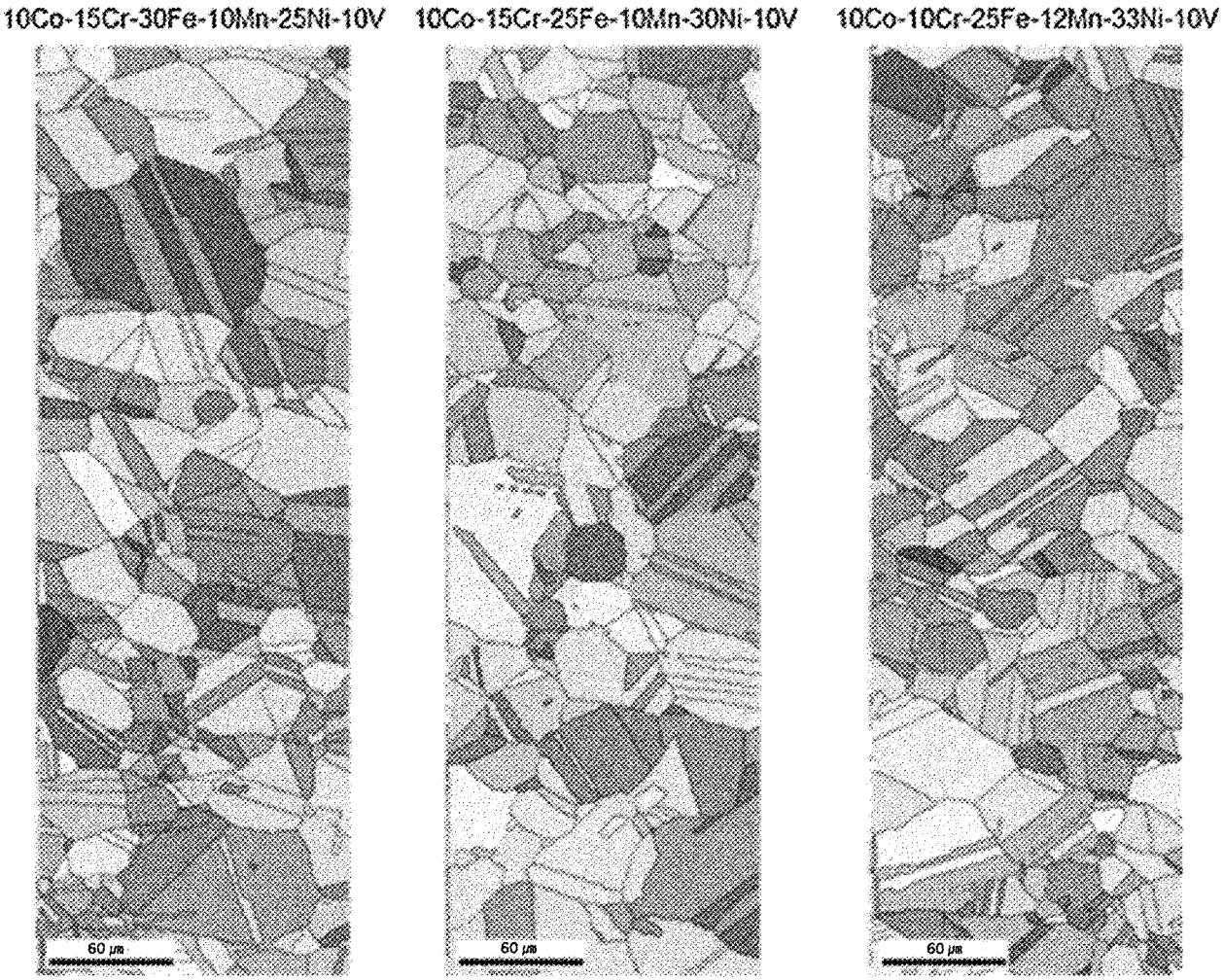

[FIG.19]
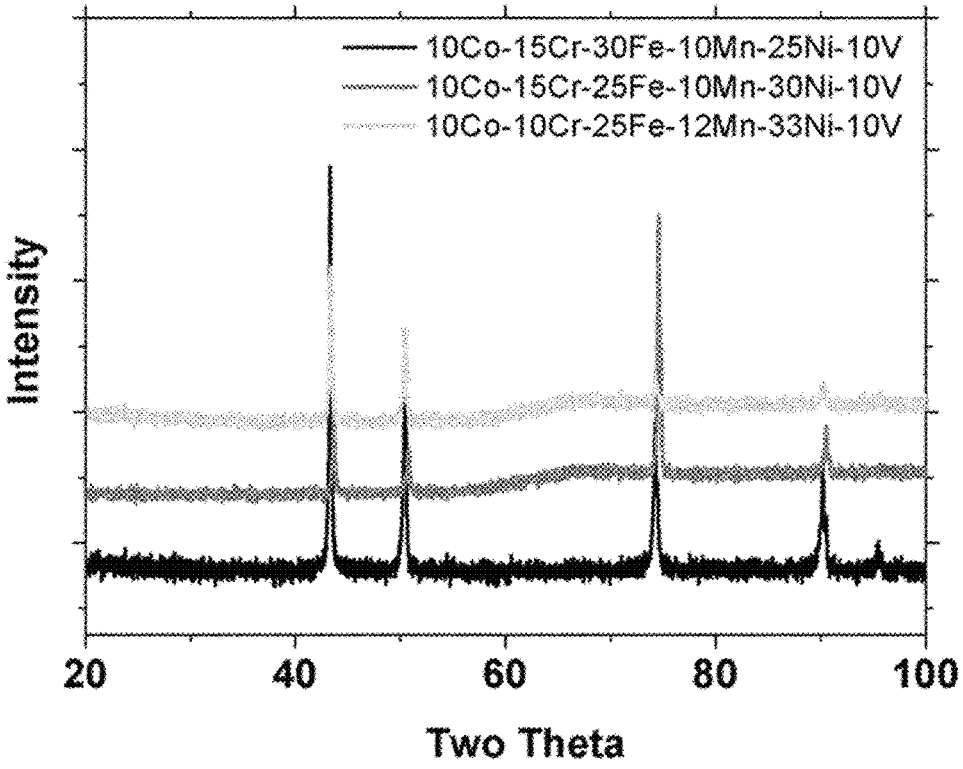

[FIG.20]
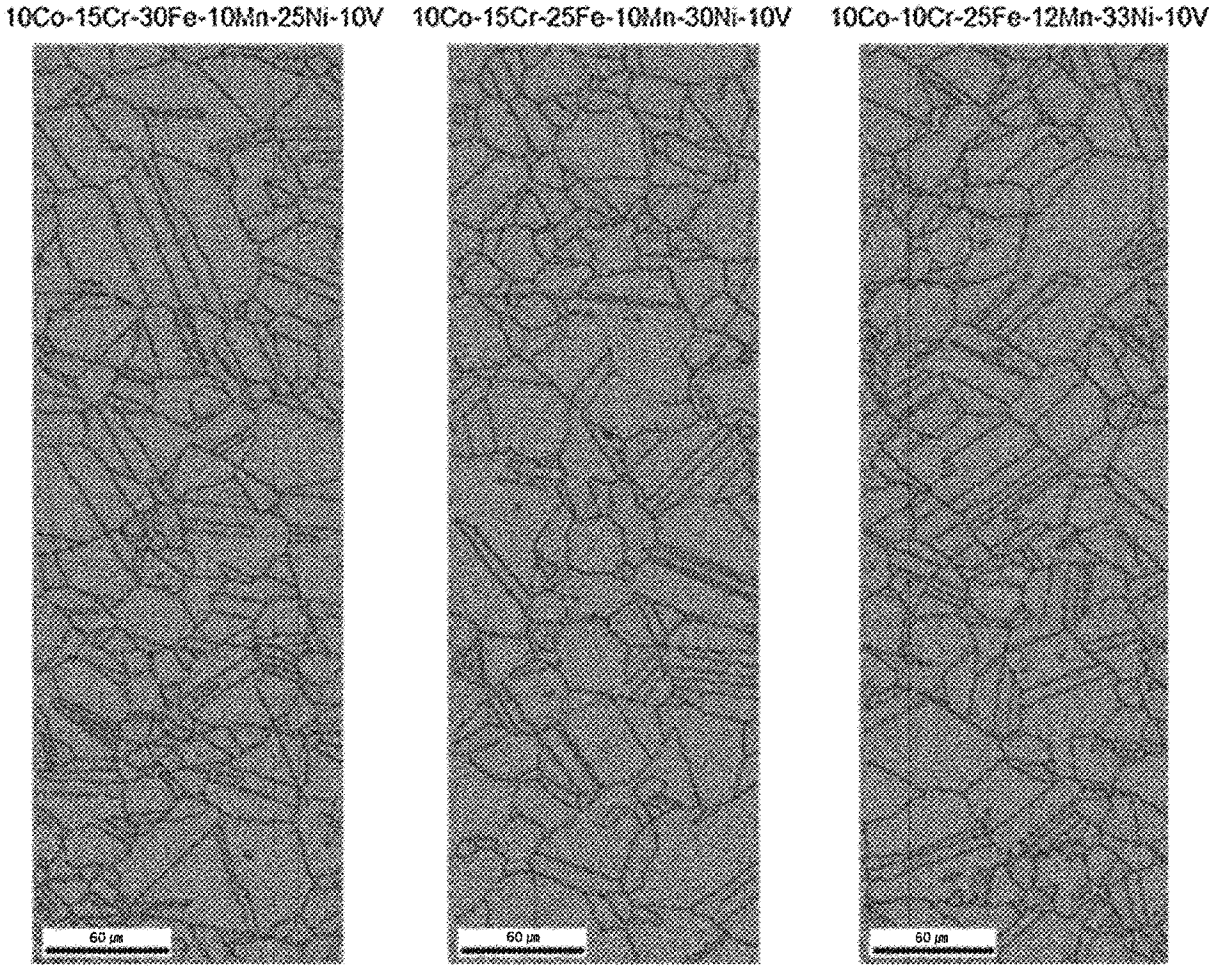

HIGH-ENTROPY ALLOY FOR ULTRA-LOW TEMPERATURE

TECHNICAL FIELD

The present invention relates to a high-entropy alloy for an ultra-low temperature, which is designed using thermodynamic calculations among computational simulation techniques, and more particularly to, a high-entropy alloy having excellent ultra-low temperature tensile strength and elongation by setting up an alloy composition region having a single-phase microstructure of a face centered cubic (FCC) at 700° C. or higher through thermodynamic calculations, and by allowing the FCC single-phase microstructure to be obtained at room temperature and an ultra-low temperature when quenching after heat treatment at 700° C. or higher is performed.

BACKGROUND ART

A high-entropy alloy (HEA) is a multi-element alloy composed of 5 or more elements, and is a new material of a new concept, which is composed of a face centered cubic (FCC) single phase or a body centered cubic (BCC) single phase and has excellent ductility without generating an intermetallic compound due to a high mixing entropy even through it is a high alloy system.

It has been reported in academic circles in 2004 under the name of High Entropy Alloy (HEA) that a single phase is obtained without an intermediate phase when five or more elements are alloyed with a similar ratio without a main element, and recently, there is an explosion of related research due to the sudden interest.

The reason why this particular atomic arrangement structure appears, and the characteristics thereof are not clear. However, the excellent chemical and mechanical properties of such structure have been reported, and an FCC single phase CoCrFeMnNi high-entropy alloy is reported to have a high yield and tensile strength due to the appearance of a twin in a nano unit at a low temperature, and to have the highest toughness when compared with materials reported so far.

A high-entropy alloy having a face centered cubic (FCC) structure has not only excellent fracture toughness at an ultra-low temperature but also excellent corrosion resistance, and excellent mechanical properties such as high strength and high ductility, so that the development thereof as a material for an ultra-low temperature is being promoted.

Meanwhile, Korean Patent Laid-Open Publication No. 2016-0014130 discloses a high-entropy alloy such as $Ti_{16.6}Zr_{16.6}Hf_{16.6}Ni_{16.6}Cu_{16.6}Co_{17}$, and $Ti_{16.6}Zr_{16.6}Hf_{16.6}Ni_{16.6}Cu_{16.6}Nb_{17}$ both of which can be used as a heat resistant material, and Japanese Patent Laid-Open Publication No. 2002-173732 discloses a highly-entropy alloy which has Cu—Ti—V—Fe—Ni—Zr as a main element and has high hardness and excellent corrosion resistance.

As such, various high-entropy alloys are being developed, and in order to expand the application area of high-entropy alloys, it is required to develop a high-entropy alloy having various properties while reducing manufacturing costs thereof.

DISCLOSURE OF THE INVENTION

Technical Problem

The purpose of the present invention is to provide a high-entropy alloy which has an FCC single phase structure at room temperature and at an ultra-low temperature and having low temperature tensile strength and low temperature elongation properties which is capable of being suitably used at an ultra-low temperature.

Technical Solution

An aspect of the present invention to achieve the above mentioned purpose provides a high-entropy alloy including Co: 3-12 at %, Cr: 3-18 at %, Fe: 3-50 at %, Mn: 3-20 at %, Ni: 17-45 at %, V: 3-12 at %, and unavoidable impurities, wherein the ratio of the V content to the Ni content (V/Ni) is 0.5 or less, and the sum of the V content and the Co content is 22 at % or less.

An alloy having such a composition is composed of a single phase of FCC without generating an intermediate phase such as a sigma phase, and exhibits more excellent tensile strength and elongation at an ultra-low temperature (77K) than at room temperature (298K).

Advantageous Effects

A new high-entropy alloy provided by the present invention has improved tensile strength and elongation at an ultra-low temperature rather than at room temperature, and therefore, is particularly useful as a structural material used in an extreme environment such as an ultra-low temperature environment.

In addition, a high-entropy alloy according to the present invention may obtain a strengthening effect more easily than conventional materials by adding vanadium (V) having a different nearest neighbor atomic distance.

In addition, by reducing the content of expensive Co but instead adding vanadium (V) appropriately in accordance with the Ni and Co contents, it is possible to manufacture a high-entropy alloy at low costs when compared with the prior art, and by suppressing the generation of a sigma phase and implementing an FCC single phase, it is possible to obtain mechanical properties equal to or higher than those of a conventional high-entropy alloy without performing a strictly controlled heat treatment process.

BRIEF DESCRIPTION OF THE DRAWINGS

FIG. 1 shows phase equilibrium information at 700° C. of an alloy containing 10 at % of cobalt (Co) and 15 at % of chromium (Cr) according to mole fractions of iron (Fe), manganese (Mn), and nickel (Ni) which constitute the remainder of the alloy.

FIG. 2 shows change in equilibrium phase according to the temperature for an alloy having a composition represented by a star (★) in FIG. 1.

FIG. 3 shows phase equilibrium information at 700° C. of an alloy containing 10 at % of cobalt (Co), 15 at % of chromium (Cr), and 10 at % of vanadium (V) according to mole fractions of iron (Fe), manganese (Mn), and nickel (Ni) which constitute the remainder of the alloy.

FIG. 4 shows change in equilibrium phase according to the temperature for an alloy having a composition represented by a star (★) in FIG. 3.

FIG. 5 shows change in equilibrium phase according to the temperature for an alloy having a composition represented by an empty star (☆) in FIG. 3.

FIG. 6 shows phase equilibrium information at 700° C. of an alloy containing 10 at % of cobalt (Co), 10 at % of chromium (Cr), and 10 at % of vanadium (V) according to mole fractions of iron (Fe), manganese (Mn), and nickel (Ni) which constitute the remainder of the alloy.

FIG. 7 shows change in equilibrium phase according to the temperature for an alloy having a composition represented by a star (★) in FIG. 6.

FIG. 8 shows phase equilibrium information at 700° C. of an alloy containing 10 at % of cobalt (Co), 15 at % of chromium (Cr), and 5 at % of vanadium (V) according to mole fractions of iron (Fe), manganese (Mn), and nickel (Ni) which constitute the remainder of the alloy.

FIG. 9 shows change in equilibrium phase according to the temperature for an alloy having a composition represented by a star (★) in FIG. 8.

FIG. 10 shows phase equilibrium information at 700° C. of an alloy containing 5 at % of cobalt (Co), 15 at % of chromium (Cr), and 10 at % of vanadium (V) according to mole fractions of iron (Fe), manganese (Mn), and nickel (Ni) which constitute the remainder of the alloy.

FIG. 11 shows change in equilibrium phase according to the temperature for an alloy having a composition represented by a star (★) in FIG. 10.

FIG. 12 shows phase diagrams of binary alloy systems composed of two elements among six elements of cobalt (Co), chromium (Cr), iron (Fe), manganese (Mn), nickel (Ni), and vanadium (V).

FIG. 13 is a photograph of an EBSD inverse pole figure (IPF) map of a high-entropy alloy according to the present invention.

FIG. 14 shows results of an X-ray diffraction analysis of a high-entropy alloy according to the present invention.

FIG. 15 is a photograph of an EBSD phase map of a high-entropy alloy according to the present invention.

FIG. 16 shows results of a tensile test of a high-entropy alloy according to the present invention at room temperature (298K).

FIG. 17 shows results of a tensile test of a high-entropy alloy according to the present invention at an ultra-low temperature (77K).

FIG. 18 is a photograph of an EBSD inverse pole figure (IPF) map after performing heat treatment in which a high entropy alloy according to the present invention is heated at 1000° C. for 24 hours.

FIG. 19 shows results of an X-ray diffraction analysis after performing heat treatment in which a high entropy alloy according to the present invention is heated at 1000° C. for 24 hours.

FIG. 20 is a photograph of an EBSD phase map after performing heat treatment in which a high entropy alloy according to the present invention is heated at 1000° C. for 24 hours.

BEST MODE FOR CARRYING OUT THE INVENTION

Hereinafter, the configuration and the operation of embodiments of the present invention will be described with reference to the accompanying drawings. In describing the present invention, a detailed description of related known functions and configurations will be omitted when it may unnecessarily make the gist of the present invention obscure. Also, when a certain portion is referred to "include" a certain element, it is understood that it may further include other elements, not excluding the other elements, unless specifically stated otherwise.

FIG. 1 shows phase equilibrium information at 700° C. of an alloy containing 10 at % of cobalt (Co) and 15 at % of chromium (Cr) according to mole fractions of iron (Fe), manganese (Mn), and nickel (Ni) which constitute the remainder of the alloy.

Regions 1 and 2 represent regions in which an FCC single phase is maintained at 700° C. or lower, and the remaining regions show regions in which two-phase or three-phase equilibrium are maintained. Alloys having a composition belonging to the Region 2 of FIG. 1 maintain the FCC single phase from a melting temperature down to 700° C. or lower, to 500° C. At this time, a composition located at a boundary portion of the two-phase equilibrium region maintains the FCC single phase down to 700° C. in calculation.

A line between the Region 1 and the Region 2 is a line representing a boundary between the FCC single phase region and the two-phase equilibrium region calculated at 500° C. Alloys having a composition belonging to the Region 1 of FIG. 1 maintain the FCC single phase from a melting temperature down to 500° C. or lower. A composition located at a boundary between the Region 1 and the Region 2 maintains the FCC single phase down to 500° C. in calculation.

FIG. 2 shows change in equilibrium phase according to the temperature for an alloy having a composition represented by a star (★) in FIG. 1. The alloy having the composition represented by the star (★) is the composition located at the boundary between the Region 1 and the Region 2 in FIG. 1, thereby generating the FCC single phase region from the melting temperature to 500° C.

FIG. 1 means that alloys composed of 5 elements or less including 10 at % of cobalt (Co), 15 at % of chromium (Cr), 0-65 at % of iron (Fe), 0-45 at % of manganese (Mn), and 5-75 at % of nickel (Ni) all maintain the FCC single phase from the melting temperature to 700° C. or lower.

FIG. 3 shows phase equilibrium information at 700° C. of an alloy containing 10 at % of cobalt (Co), 15 at % of chromium (Cr), and 10 at % of vanadium (V) according to mole fractions of iron (Fe), manganese (Mn), and nickel (Ni) which constitute the remainder of the alloy.

FIG. 3 means that alloys of 6 elements or less including 10 at % of cobalt (Co), 15 at % of chromium (Cr), 10 at % of vanadium (V), 0-47 at % of iron (Fe), 0-27 at % of manganese (Mn), and 18-65 at % of nickel (Ni) all maintain the FCC single phase from the melting temperature to 700° C. or lower.

FIG. 4 shows change in equilibrium phase according to the temperature for an alloy having a composition represented by a star (★) in FIG. 3, and FIG. 5 shows change in equilibrium phase according to the temperature for an alloy having a composition represented by an empty star (☆) in FIG. 3.

FIG. 6 shows phase equilibrium information at 700° C. of an alloy containing 10 at % of cobalt (Co), 10 at % of chromium (Cr), and 10 at % of vanadium (V) according to mole fractions of iron (Fe), manganese (Mn), and nickel (Ni) which constitute the remainder of the alloy.

FIG. 6 means that alloys of 6 elements or less including 10 at % of cobalt (Co), 10 at % of chromium (Cr), 10 at % of vanadium (V), 0-52 at % of iron (Fe), 0-42 at % of manganese (Mn), and 17-70 at % of nickel (Ni) all maintain the FCC single phase from the melting temperature to 700° C. or lower.

FIG. 7 shows change in equilibrium phase according to the temperature for an alloy having a composition represented by a star (★) in FIG. 6.

FIG. 8 shows phase equilibrium information at 700° C. of an alloy containing 10 at % of cobalt (Co), 15 at % of chromium (Cr), and 5 at % of vanadium (V) according to mole fractions of iron (Fe), manganese (Mn), and nickel (Ni) which constitute the remainder of the alloy.

FIG. 8 means that alloys of 6 elements or less including 15 at % of cobalt (Co), 15 at % of chromium (Cr), 5 at % of vanadium (V), 0-56 at % of iron (Fe), 0-42 at % of manganese (Mn), and 9-70 at % of nickel (Ni) all maintain the FCC single phase from the melting temperature to 700° C. or lower.

FIG. 9 shows change in equilibrium phase according to the temperature for an alloy having a composition represented by a star (★) in FIG. 8.

FIG. 10 shows phase equilibrium information at 700° C. of an alloy containing 5 at % of cobalt (Co), 15 at % of chromium (Cr), and 10 at % of vanadium (V) according to mole fractions of iron (Fe), manganese (Mn), and nickel (Ni) which constitute the remainder of the alloy.

FIG. 10 means that alloys of 6 elements or less including 5 at % of cobalt (Co), 15 at % of chromium (Cr), 10 at % of vanadium (V), 0-46 at % of iron (Fe), 0-32 at % of manganese (Mn), and 24-70 at % of nickel (Ni) all maintain the FCC single phase from the melting temperature to 700° C. or lower.

FIG. 11 shows change in equilibrium phase according to the temperature for an alloy having a composition represented by a star (★) in FIG. 10.

FIG. 12 shows phase diagrams of binary systems composed of two elements among six elements of cobalt (Co), chromium (Cr), iron (Fe), manganese (Mn), nickel (Ni), and vanadium (V). In FIG. 12, the FCC single phase region and a sigma phase region which deteriorates mechanical characteristics are shown in dark color.

As shown in FIG. 12, ten binary alloy systems not including vanadium (V) have a small sigma phase region and a widely distributed FCC single phase region. On the other hand, five binary alloy systems including vanadium (V) have a relatively wide sigma phase region. Particularly, in the cases of a cobalt (Co)-vanadium (V) binary system, and a nickel (Ni)-vanadium (V) binary system, the sigma phase region is distributed to a high temperature at which a liquid phase is stable. However, in the nickel (Ni)-vanadium (V) alloy system phase diagram, the sigma phase mainly appears in a section in which the ratio of vanadium (V) content to nickel (Ni) content (V/Ni) is high, and a wide FCC single phase appears in a section in which the ratio of vanadium (V) content to nickel (Ni) content (V/Ni) is low.

Through thermodynamic information as described above, inventors of the present invention have tried to implement a high-entropy alloy composed of an FCC single phase by reducing the ratio of V content to Ni content (V/Ni), and by reducing the content of cobalt (Co) and the content of vanadium (V) in which a sigma phase appears in the center of a phase diagram.

The present invention relates to a high-entropy alloy composed of an FCC single phase and having excellent ultra-low temperature properties, the alloy including 3-12 at % of Co, 3-18 at % of Cr, 3-50 at % of Fe, 3-20 at % of Mn, 17-45 at % of Ni, 3-12 at % of V, and unavoidable impurities, wherein the ratio of the V content to the Ni content (V/Ni) is 0.5 or less, and the sum of the V content and the Co content is 22 at % or less.

When the content of the Co is less than 3 at %, a phase becomes unstable, and when greater than 12 at %, manufacturing costs and the possibility of an intermediate phase being generated are increased. Therefore, the content of the Co is preferably 3-12 at %. When phase stability, mechanical properties, and manufacturing costs are considered, the content of the Co is more preferably 7-12 at %.

When the content of Cr is less than 3 at %, it is disadvantageous to physical properties of an alloy such as corrosion resistance, and when the content of Cr is greater than 18 at %, the possibility an intermediate phase being generated is increased. Therefore, the content of the Cr is preferably 3-18 at %. When phase stability and mechanical properties are considered, the content of the Cr is more preferably 7-18 at %.

When the content of Fe is less than 3 at %, it is disadvantageous to manufacturing costs, and when the content of Fe is greater than 50 at %, the phase becomes unstable. Therefore, the content of the Fe is preferably 3-50 at %. When phase stability and mechanical properties are considered, the content of the Fe is more preferably 18-35 at %.

When the content of Mn is less than 3 at %, it is disadvantageous to manufacturing costs, and when the content of Mn is greater than 20 at %, the phase becomes unstable and there is a possibility of an oxide is formed during a manufacturing process. Therefore, the content of the Mn is preferably 3-20 at %. When phase stability and mechanical properties are considered, the content of the Mn is more preferably 10-20 at %.

When the content of Ni is less than 17 at %, the phase becomes unstable, and when the content of Ni is greater than 45 at %, it is disadvantageous to manufacturing costs. Therefore, the content of the Ni is preferably 17-45 at %. When phase stability and mechanical properties are considered, the content of the Ni is more preferably 25-45 at %.

When the content of V is less than 3 at %, it is difficult to obtain a strengthening effect and when the content of V is greater than 12 at %, the possibility of an intermediate phase being generated is increased. Therefore, the content of the V is 3-12 atom % is preferable. When phase stability, mechanical properties, and manufacturing costs are considered, the content of the V is more preferably 5-12 at %.

In addition, when the ratio of the V content to the Ni content (V/Ni) is greater than 0.5, a sigma phase may be generated and thus an FCC single phase structure may not be implemented. Therefore, it is preferable that the ratio of the V content to the Ni content (V/Ni) is 0.5 or less.

In addition, in the present invention, in order to implement an FCC single phase structure while reducing the content of expensive Co, an influence of a Co—V alloy system is reduced by minimizing the content of Co. To this end, it is preferable that the sum of the contents of Co and V is 22 at % or less.

It is preferable to maintain the composition ranges of an alloy since it becomes difficult to obtain a solid solution having an FCC single phase when the composition ranges deviate from respective composition constituting the alloy.

In addition, in the high-entropy alloy, when the content of Co, Cr and V is respectively 10 at % or greater, better properties are exhibited. Therefore, it is preferable that the sum of the Fe, the Mn, and the Ni is less than 70 at %.

In addition, in the high-entropy alloy, when the content of Ni is 20 at % or greater, optimal properties are exhibited. Therefore, it is preferable that the sum of the Fe and the Mn is less than 50 at %.

In addition, the high-entropy alloy may have tensile strength of 1000 MPa or greater and elongation of 40% or greater at an ultra-low temperature (77K).

In addition, the high-entropy alloy may have tensile strength of 1000 MPa or greater and elongation of 60% or greater at an ultra-low temperature (77K).

In addition, the high-entropy alloy may have tensile strength of 700 MPa or greater and elongation of 40% or greater at room temperature (298K).

In addition, the high-entropy alloy may have tensile strength of 700 MPa or greater and elongation of 60% or greater at room temperature (298K).

Hereinafter, the present invention will be described in more detail based on preferred embodiments of the present invention, but the present invention should not be construed as being limited to the preferred embodiments of the present invention.

Example 1

Manufacturing a High-Entropy Alloy

Table 1 below shows five compositions selected for manufacturing an alloy of a region calculated through the thermodynamic review described above.

TABLE 1

| | Composition (at %) | | | | | |
|---|---|---|---|---|---|---|
| | Co | Cr | Fe | Mn | Ni | V |
| Example 1 | 10 | 15 | 30 | 10 | 25 | 10 |
| Example 2 | 10 | 15 | 25 | 10 | 30 | 10 |
| Example 3 | 10 | 10 | 25 | 12 | 33 | 10 |
| Example 4 | 10 | 15 | 20 | 20 | 30 | 5 |
| Example 5 | 5 | 15 | 20 | 10 | 40 | 10 |

Co, Cr, Fe, Mn, Ni, and V of 99.9% or greater of high purity were prepared so as to have the composition shown in Table 1, and an alloy was melted at a temperature of 1500° C. or higher using a vacuum induction melting furnace to prepare an ingot by a known method.

The ingot prepared as described above was maintained in an FCC single phase region at 1000° C. for 2 hours to homogenize the structure thereof, and then the homogenized ingot was pickled to remove impurities and an oxide layer on the surface thereof.

The pickled ingot was cold-rolled at a reduction ratio of 75% to produce a cold rolled-plate.

The cold-rolled plate as such was subjected to heat treatment (800° C., 2 hours) in the FCC single phase region to remove residual stress, and a crystal grain was completely recrystallized and then water-cooled.

Microstructure and mechanical properties were not evaluated for Examples 4 and 5 of Table 1 above, but as shown in FIGS. 9 to 11, it can be seen that it is a composition capable of generating an FCC single phase at room temperature (298K) and at an ultra-low temperature (77K) when quenching (for example, water cooling) after heat treatment in the FCC single phase region (800° C. or higher) is performed.

Microstructure

The microstructure of a high-entropy alloy manufactured as described above was analyzed using a scanning electron microscope, an X-ray diffraction analyzer, and an EBSD.

FIG. 13 is a photograph of an EBSD inverse pole figure (IPF) map of three high-entropy alloys manufactured according to Examples 1 to 3. It is possible to measure the size of the crystal grain from the EBSD IPF map, and the two alloys which were subjected to cold rolling at the reduction ratio of 75% and recrystallization heat treatment have a crystal grain size of 3.6-7.1 u m. Crystal phases have a polycrystalline shape, and the size thereof is relatively uniform regardless of the composition of the alloy.

FIG. 14 shows results of an X-ray diffraction analysis of three high-entropy alloys manufactured according to Examples 1 to 3. All three alloys exhibit the same peak, and according to the analysis result thereof, it was confirmed that the peak corresponds to an FCC structure.

FIG. 15 is a photograph of an EBSD phase map of three high-entropy alloys manufactured according to Examples 1 to 3. The EBSD phase map displays each phase in different colors when two or more different phases are in the microstructure. All three alloys are represented in the same single color, which means that the microstructure of the alloy is composed of an FCC single phase.

Evaluation of Mechanical Properties at Room Temperature and at an Ultra-Low Temperature Tensile properties of the high-entropy alloy manufactured according to Examples 1 to 3 were evaluated at room temperature (298K) through a tensile tester. FIG. 16 and Table 2 show the results.

TABLE 2

| | Room temperature (298 K) | | |
|---|---|---|---|
| | YS (MPa) | UTS (MPa) | El. (%) |
| Example 1 | 486 | 801 | 60.0 |
| Example 2 | 479 | 801 | 44.1 |
| Example 3 | 489 | 775 | 40.7 |

As shown in Table 2, the high-entropy alloy according to Examples 1 to 3 of the present invention exhibits excellent tensile properties at room temperature (298K) having a yield strength of 486-489 MPa, tensile strength of 775-801 MPa, and elongation of 40.7-60%.

FIG. 17 and Table 3 below show results of evaluating tensile properties at an ultra-low temperature (77K) using an ultra-low temperature chamber and a tensile tester.

TABLE 3

| | Ultra-low temperature (77 K) | | |
|---|---|---|---|
| | YS (MPa) | UTS (MPa) | El. (%) |
| Example 1 | 661 | 1168 | 81.6 |
| Example 2 | 671 | 1138 | 61.6 |
| Example 3 | 641 | 1028 | 44.5 |

As shown in Table 3, the high-entropy alloy according to Examples 1 to 3 of the present invention exhibits more excellent tensile properties at an ultra-low temperature (77K) having a yield strength of 641-671 MPa, tensile strength of 1028-1168 MPa, and elongation of 44.5-81.6%.

Evaluation of Phase Stability According to Heat Treatment Conditions

As disclosed in a non-patent document (Effect of V content on microstructure and mechanical properties of the CoCrFeMnNiVx high entropy alloys, Journal of Alloys and Compounds 628 (2015) 170-185), in the case of a CoCrFeMnNiVx (x=0.25, 0.5, 0.75, 1), it is known that a sigma phase is generated which deteriorates mechanical properties of a high-entropy alloy depending on heat treatment conditions, such as heat treatment at 1000° C. for 24 hours.

When heat treatment was performed in which the high entropy alloy according to the present invention was heated at 1000° C. for 24 hours, whether a sigma phase was generated or not was confirmed, and the results are shown in FIGS. 18 to 20.

FIG. 18 is a photograph of an EBSD inverse pole figure (IPF) map after performing heat treatment in which a high entropy alloy according to the present invention was heated at 1000° C. for 24 hours. FIG. 19 shows results of an X-ray diffraction analysis after performing heat treatment in which a high entropy alloy according to the present invention was heated at 1000° C. for 24 hours. FIG. 20 is a photograph of an EBSD phase map after performing heat treatment in which a high entropy alloy according to the present invention was heated at 1000° C. for 24 hours.

As shown in FIG. 18 and FIG. 20, the size of a crystal grain was greatly increased due to the heat treatment. However, as shown in FIG. 19, the generation of a second phase, such as a sigma phase, was not observed. That is, it can be said that the high-entropy alloy manufactured according to the embodiment of the present invention has excellent stability according to heat treatment conditions when compared with a conventional high-entropy alloy.

The invention claimed is:

1. A high-entropy alloy consisting of:

Co: 3-10 at %; Cr: 3-18%; Fe: 3-50 at %; Mn: 10-20 at %; Ni: 25-45 at %; V: 3-12 at %; and unavoidable impurities.

2. The high-entropy alloy of claim 1, wherein the alloy is a single phase of a face centered cubic structure.

3. The high-entropy alloy of claim 1, wherein the sum of the Fe content and the Mn content is less than 50 at %.

4. The high-entropy alloy of claim 1, wherein the sum of the Fe content, the Mn content, and the Ni content is less than 70 at %.

5. The high-entropy alloy of claim 1, wherein the alloy has tensile strength of 1000 MPa or greater and elongation of 40% or greater at an ultra-low temperature (77 K).

6. The high-entropy alloy of claim 1, wherein the alloy has tensile strength of 1000 MPa or greater and elongation of 60% or greater at an ultra-low temperature (77 K).

7. The high-entropy alloy of claim 1, wherein the alloy has tensile strength of 700 MPa or greater and elongation of 40% or greater at room temperature (298 K).

8. The high-entropy alloy of claim 1, wherein the alloy has tensile strength of 700 MPa or greater and elongation of 60% or greater at room temperature (298 K).

9. The high-entropy alloy of claim 1, wherein no sigma phase is generated under the condition of heat treatment at 1000° C. for 24 hours.

* * * * *